US011964357B2

(12) United States Patent
Han et al.

(10) Patent No.: US 11,964,357 B2
(45) **Date of Patent: *Apr. 23, 2024**

(54) CONDITIONER, CHEMICAL MECHANICAL POLISHING APPARATUS INCLUDING THE SAME AND METHOD OF MANUFACTURING A SEMICONDUCTOR DEVICE USING THE APPARATUS

(71) Applicant: SAMSUNG ELECTRONICS CO., LTD., Suwon-si (KR)

(72) Inventors: Seungchul Han, Suwon-si (KR); Yonghee Lee, Suwon-si (KR); Taemin Earmme, Suwon-si (KR); Byoungho Kwon, Suwon-si (KR); Kuntack Lee, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/857,289

(22) Filed: Jul. 5, 2022

(65) Prior Publication Data

US 2022/0331931 A1 Oct. 20, 2022

Related U.S. Application Data

(62) Division of application No. 16/662,439, filed on Oct. 24, 2019, now Pat. No. 11,471,996.

(30) Foreign Application Priority Data

May 2, 2019 (KR) ..... 10-2019-0051237

(51) Int. Cl.
*B24B 37/005* (2012.01)
*B24B 37/20* (2012.01)

(52) U.S. Cl.
CPC ..... *B24B 37/005* (2013.01); *B24B 37/20* (2013.01)

(58) Field of Classification Search
None
See application file for complete search history.

(56) References Cited

U.S. PATENT DOCUMENTS

| | | | |
|---|---|---|---|
| 5,804,507 | A | 9/1998 | Perlov et al. |
| 5,885,137 | A | 3/1999 | Ploessl |
| 6,036,583 | A | 3/2000 | Perlov et al. |
| 6,179,693 | B1 | 1/2001 | Beardsley et al. |
| 6,217,429 | B1 | 4/2001 | Hoey |
| 6,293,853 | B1 | 9/2001 | Perlov et al. |

(Continued)

FOREIGN PATENT DOCUMENTS

| | | | |
|---|---|---|---|
| CN | 1525900 | A | 9/2004 |
| CN | 1809444 | A | 7/2006 |

(Continued)

OTHER PUBLICATIONS

Office Action dated Apr. 15, 2023 from the Chinese Patent Office for Chinese Patent Application No. 201911316149.X.

*Primary Examiner* — Sylvia MacArthur
(74) *Attorney, Agent, or Firm* — Fish & Richardson P.C.

(57) ABSTRACT

A conditioner of a chemical mechanical polishing (CMP) apparatus includes a disk to polish a polishing pad of the CMP apparatus, a driver to rotate the disk, a lifter to lift the driver, an arm to rotate the lifter, and a connector to connect the driver to the lifter, the driver being tiltable with respect to the lifter.

11 Claims, 22 Drawing Sheets

(56) References Cited

U.S. PATENT DOCUMENTS

| | | | | |
|---|---|---|---|---|
| 6,322,434 | B1 | 11/2001 | Satoh et al. | |
| 6,343,974 | B1 | 2/2002 | França et al. | |
| 6,572,440 | B2 | 6/2003 | Moore | |
| 6,648,731 | B2 | 11/2003 | Shin | |
| 6,899,604 | B2 | 5/2005 | Togawa et al. | |
| 7,108,581 | B2 | 9/2006 | Togawa | |
| 7,156,725 | B2 | 1/2007 | Togawa et al. | |
| 7,207,871 | B1 | 4/2007 | Zuniga et al. | |
| 7,288,165 | B2 | 10/2007 | Polyak et al. | |
| 7,854,646 | B2 | 12/2010 | Togawa et al. | |
| 7,963,826 | B2 | 6/2011 | Nangoy et al. | |
| 8,197,301 | B2 | 6/2012 | Bae | |
| 8,382,558 | B2 | 2/2013 | Watanabe et al. | |
| 8,662,956 | B2 | 3/2014 | Seo et al. | |
| 10,286,521 | B2 * | 5/2019 | Hara | B24B 53/017 |
| 10,335,918 | B2 | 7/2019 | Yasuda et al. | |
| 10,464,185 | B2 | 11/2019 | Isono et al. | |
| 11,426,834 | B2 | 8/2022 | Miyazaki et al. | |
| 11,741,996 | B1 * | 8/2023 | Ramesh | G06Q 30/0276 386/285 |
| 2012/0115403 | A1 | 5/2012 | Lu et al. | |
| 2014/0120804 | A1 | 5/2014 | Duescher | |
| 2014/0273767 | A1 | 9/2014 | Chen et al. | |
| 2020/0346317 | A1 | 11/2020 | Han et al. | |
| 2022/0331931 | A1 * | 10/2022 | Han | B24B 53/007 |

FOREIGN PATENT DOCUMENTS

| | | | |
|---|---|---|---|
| CN | 1943989 | A | 4/2007 |
| CN | 101238552 | A | 8/2008 |
| CN | 103839857 | A | 6/2014 |
| CN | 204868552 | U | 12/2015 |
| CN | 107186617 | A | 9/2017 |
| CN | 107614199 | A | 1/2018 |
| CN | 206825192 | U | 1/2018 |
| JP | 2008-023674 | A | 2/2008 |
| KR | 10-1559278 | B1 | 10/2015 |
| KR | 10-2017-0045014 | A | 4/2017 |

* cited by examiner

CONDITIONER, CHEMICAL MECHANICAL POLISHING APPARATUS INCLUDING THE SAME AND METHOD OF MANUFACTURING A SEMICONDUCTOR DEVICE USING THE APPARATUS

CROSS-REFERENCE TO RELATED APPLICATION

This application is a division of U.S. patent application Ser. No. 16/662,439 filed Oct. 24, 2019, which is incorporated by reference herein in its entirety.

Korean Patent Application No. 10-2019-0051237, filed on May 2, 2019, in the Korean Intellectual Property Office, and entitled: "Conditioner, Chemical Mechanical Polishing Apparatus Including the Same and Method of Manufacturing a Semiconductor Device Using the Apparatus," is incorporated by reference herein in its entirety.

BACKGROUND

1. Field

Example embodiments relate to a conditioner, a chemical mechanical polishing (CMP) apparatus including the conditioner, and a method of manufacturing a semiconductor device using the CMP apparatus. More particularly, example embodiments relate to a conditioner for polishing a polishing pad, a CMP apparatus including the conditioner, and a method of manufacturing a semiconductor device using the CMP apparatus.

2. Description of the Related Art

Generally, a CMP apparatus may be used for planarizing a layer on a semiconductor substrate. The CMP apparatus may include a CMP mechanism having a polishing pad and a conditioner for conditioning the polishing pad via a conditioning disk. In order to prepare an inclining of the polishing pad with respect to the conditioner, the conditioner may include a connection module.

SUMMARY

According to example embodiments, there may be provided a conditioner of a CMP apparatus. The conditioner may include a disk to polish a polishing pad of the CMP apparatus, a driver to rotate the disk, a lifter to lift the driver, an arm to rotate the lifter, and a connector to connect the driver to the lifter, the driver being tiltable with respect to the lifter.

According to example embodiments, there may be provided a conditioner of a CMP apparatus. The conditioner may include a disk to polish a polishing pad of the CMP apparatus, a driver to rotate the disk, a lifter to lift the driver, an arm to rotate the lifter, a connector to connect the driver to the lifter, the driver being tiltable with respect to the lifter, and an airbag mechanism in the connector, the airbag mechanism including at least two airbags in the connector.

According to example embodiments, there may be provided a CMP apparatus. The CMP apparatus may include a platen on which a polishing pad is attached, a CMP mechanism over the platen to chemically mechanically polish a layer on a substrate, and a conditioner including a disk to polish the polishing pad, a driver to rotate the disk, a lifter to lift the driver, an arm to rotate the lifter, and a connector connecting the driver to the lifter, the driver being tiltable with respect to the lifter.

According to example embodiments, there may be provided a method of manufacturing a semiconductor device, including placing a substrate on a polishing pad, chemically mechanically polishing a layer on the substrate using the polishing pad, and conditioning the polishing pad using a conditioner, the conditioner including a disk to polish the polishing pad, a driver to rotate the disk, a lifter to lift the driver, an arm to rotate the lifter, and a connector connecting the driver to the lifter, the driver being tiltable with respect to the lifter.

BRIEF DESCRIPTION OF THE DRAWINGS

Features will become apparent to those of skill in the art by describing in detail exemplary embodiments with reference to the attached drawings, in which.

DETAILED DESCRIPTION

Hereinafter, example embodiments will be explained in detail with reference to the accompanying drawings.

Conditioner

Figure 1:
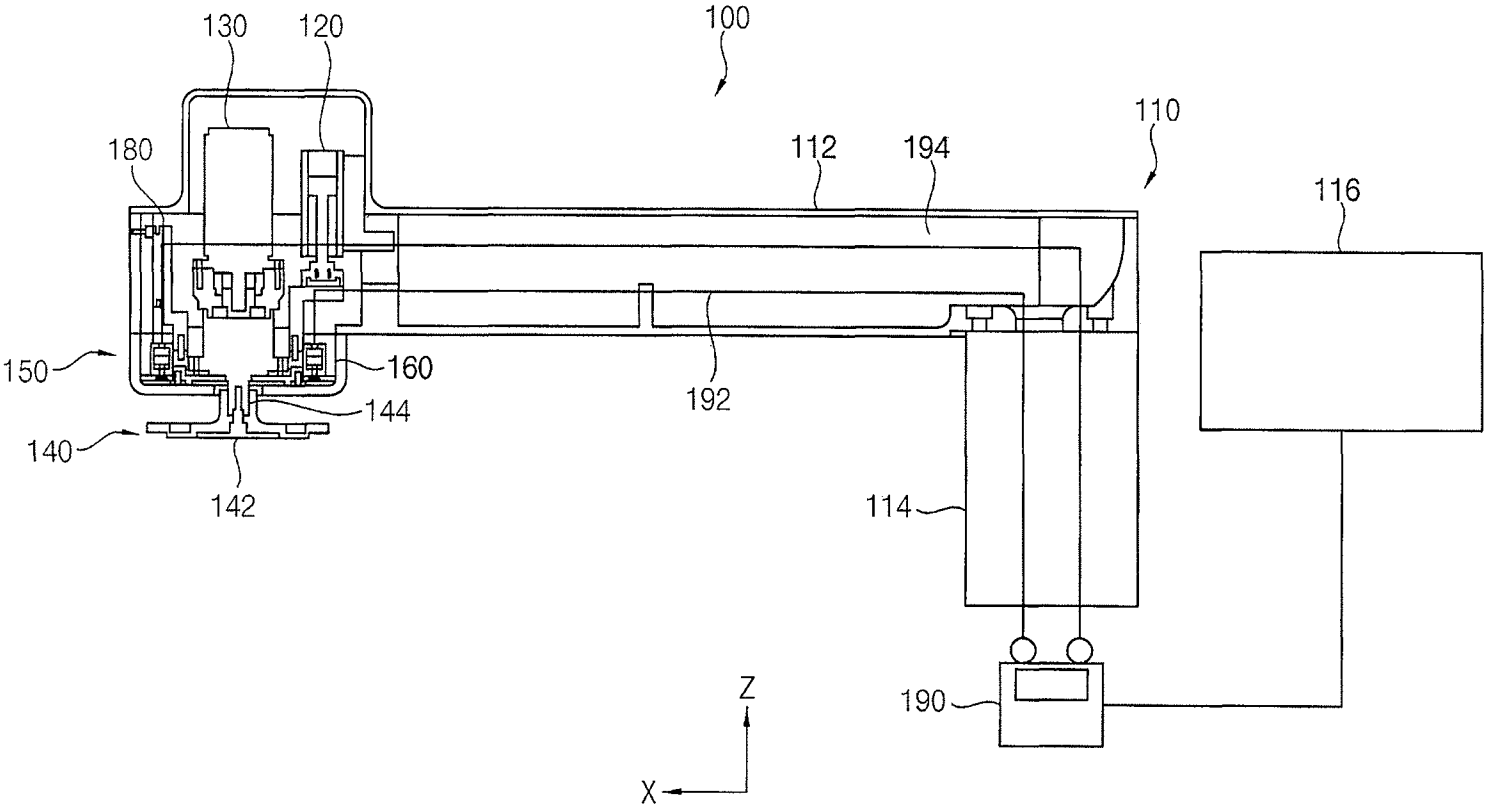
FIG. 1 illustrates a cross-sectional view of a conditioner in accordance with example embodiments.
Figure 2:
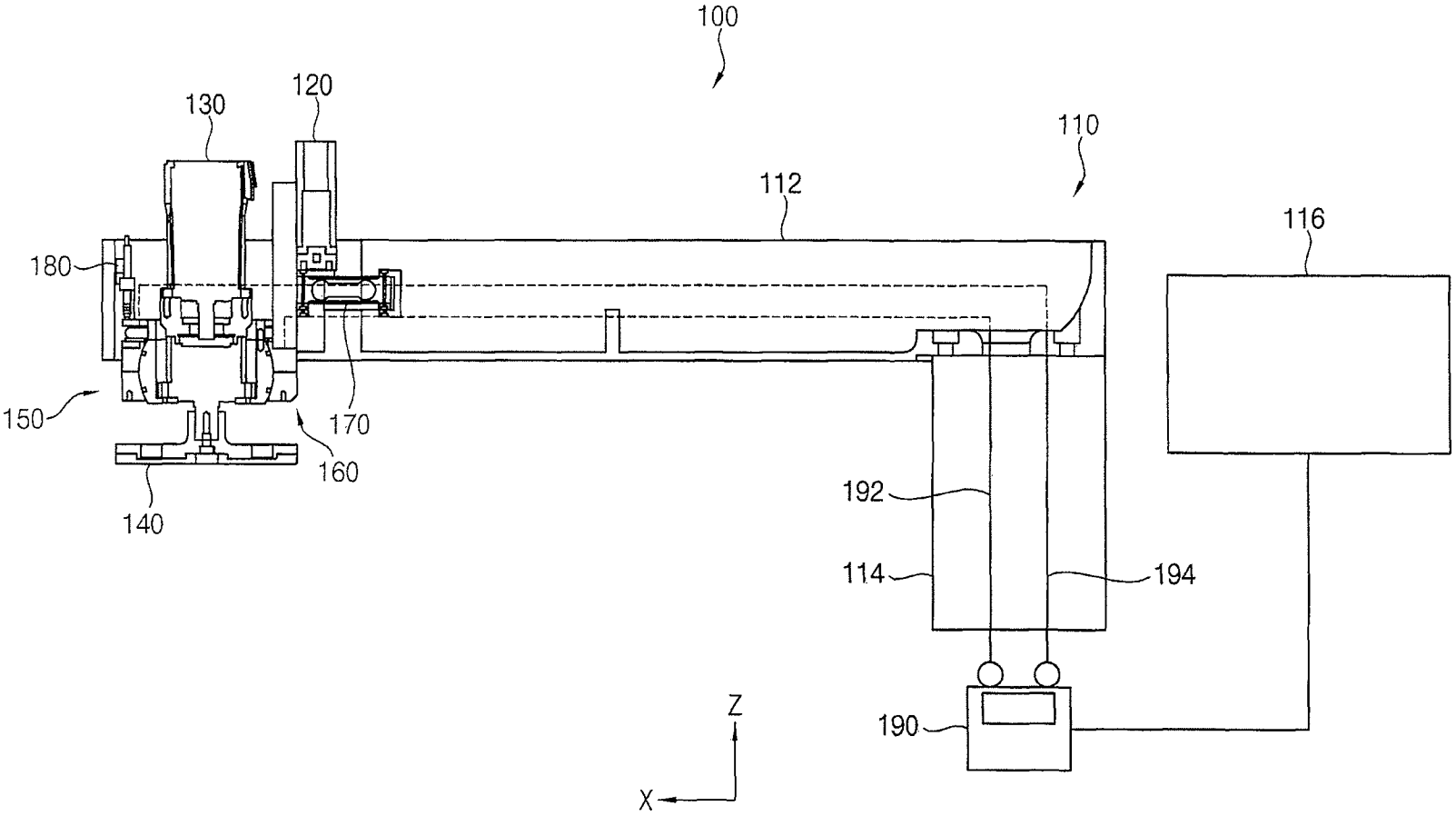
FIG. 2 illustrates a cross-sectional view of an internal structure of the conditioner in FIG. 1.
Figure 3:
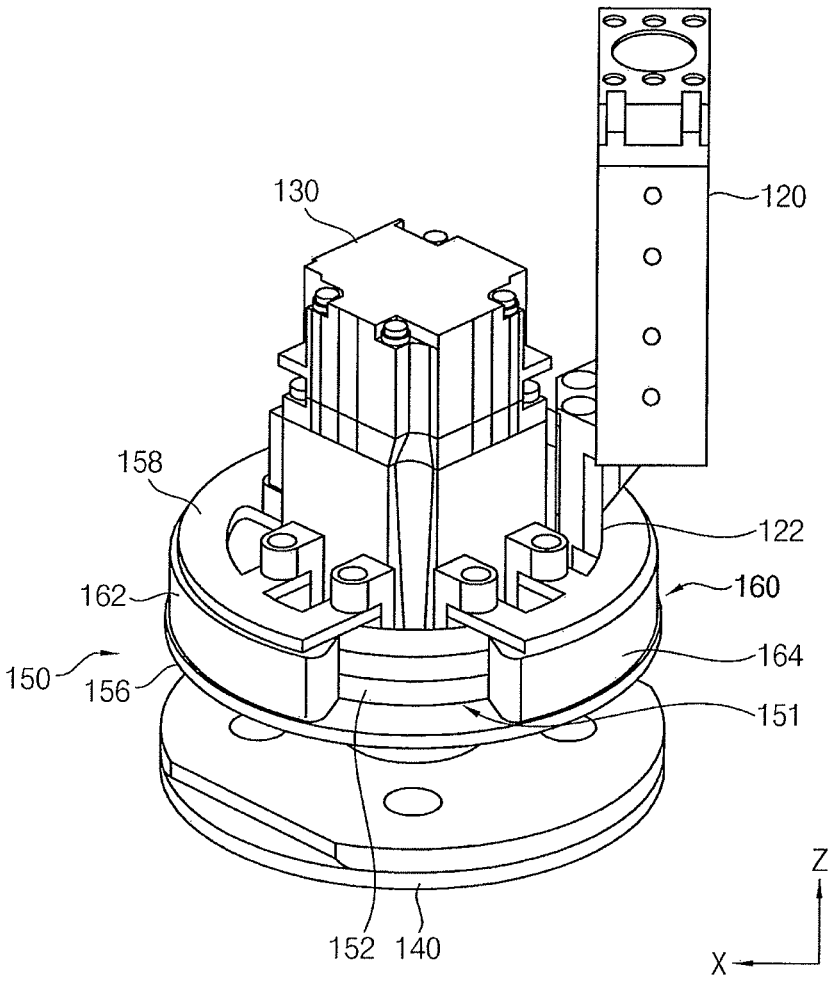
FIG. 3 illustrates a perspective view of a combination structure of a lifting module, a driving module, a connection module, and an airbag module in the conditioner of FIG. 1.
Figure 4:
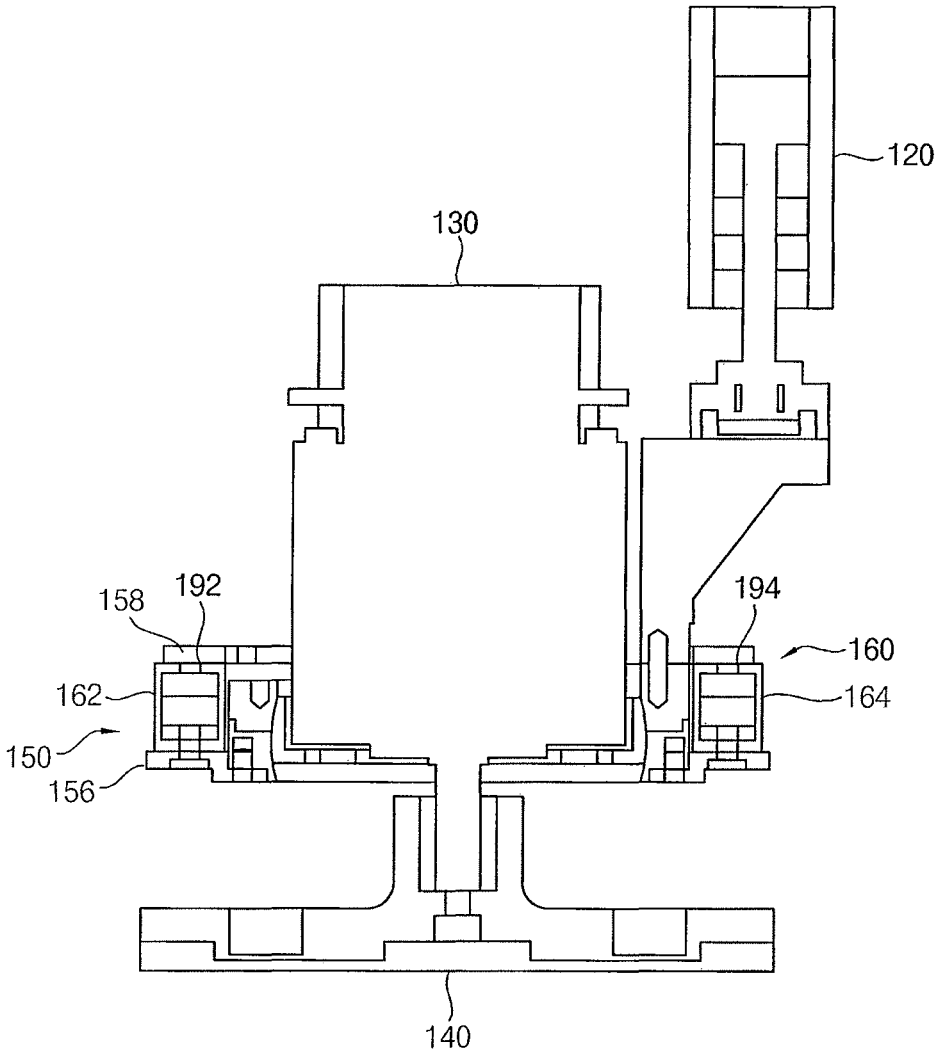
FIG. 4 illustrates a cross-sectional view of the combination structure of the lifting module, the driving module, the connection module and the airbag module in FIG. 3.
Figure 5:
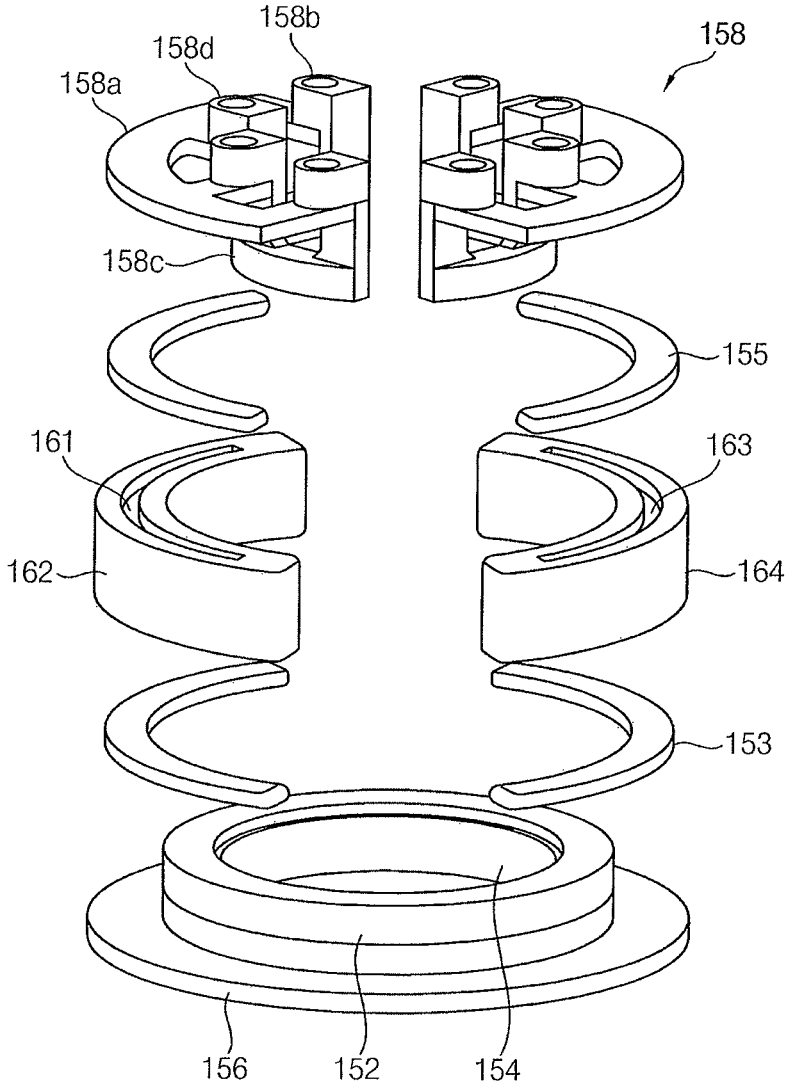
FIG. 5 illustrates an exploded perspective view of the connection module and the airbag module in FIG. 3.
Figure 6:
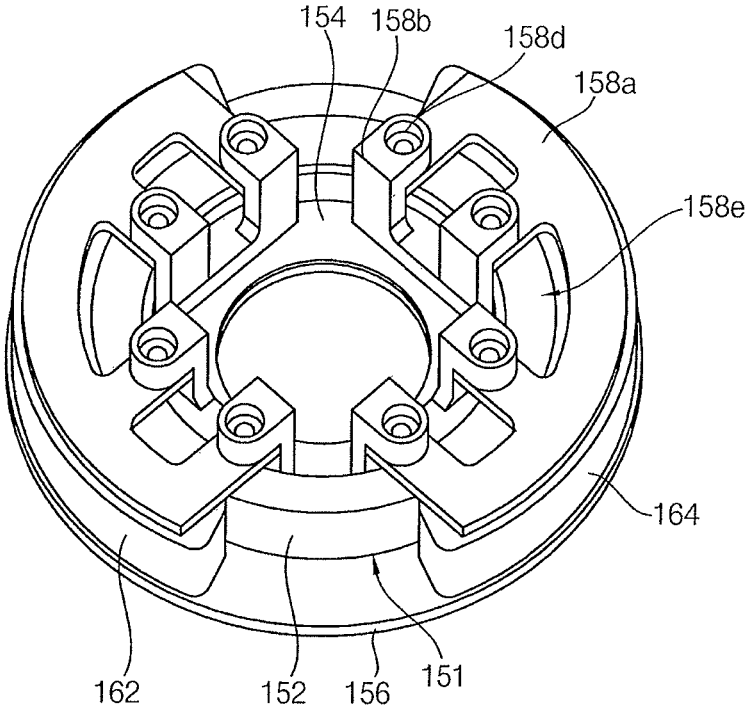
FIG. 6 illustrates a perspective view of the connection module and the airbag module in FIG. 5.
Figure 7:
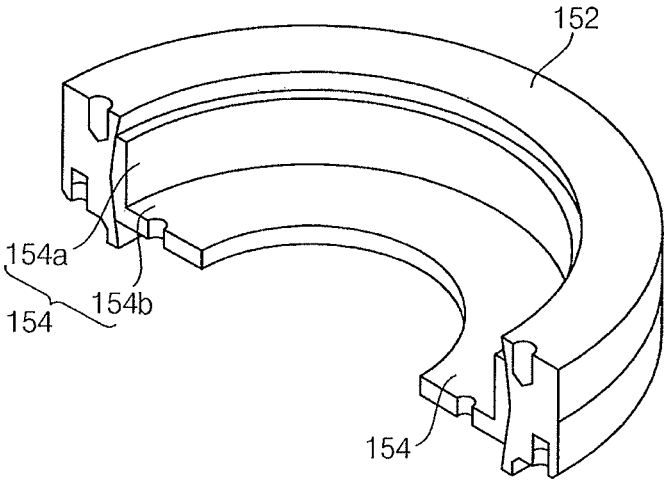
FIG. 7 illustrates a perspective view of an internal structure of a spherical bearing in the connection module of FIG. 5.
Figure 8:
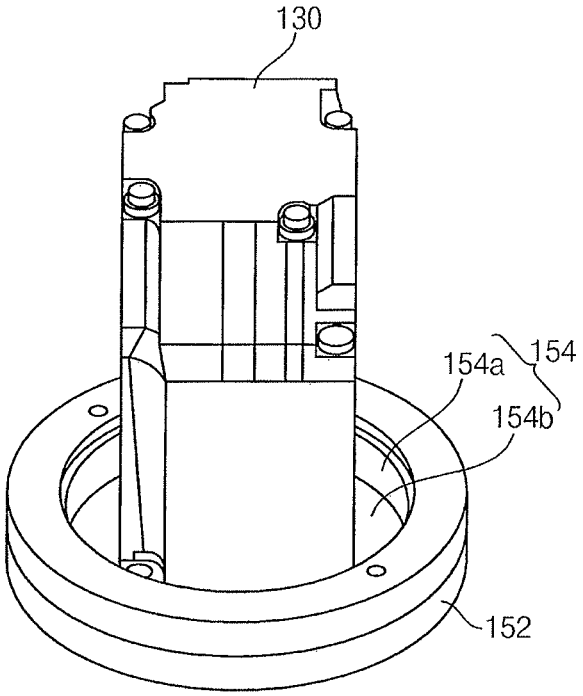
FIG. 8 illustrates a perspective view of a combination structure of the driving module and the spherical bearing in FIG. 7.
Figure 9:
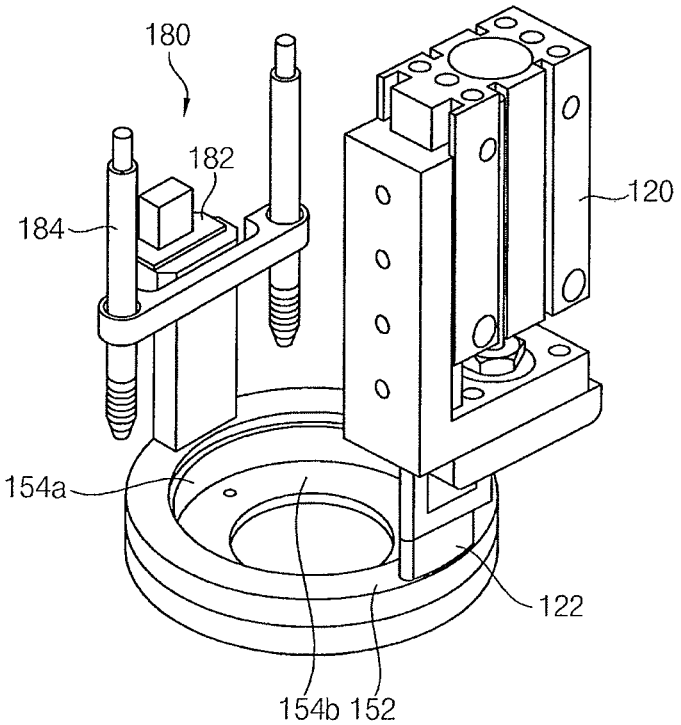
FIG. 9 illustrates a perspective view of a combination structure of the lifting module and the spherical bearing in FIG. 7.

FIG. 1 is a cross-sectional view illustrating a conditioner in accordance with example embodiments, FIG. 2 is a cross-sectional view illustrating an internal structure of the conditioner in FIG. 1, FIG. 3 is a perspective view illustrating a combination structure of a lifting module, a driving module, a connection module and an airbag module in the conditioner of FIG. 1, FIG. 4 is a cross-sectional view illustrating the combination structure of the lifting module, the driving module, the connection module and the airbag module in FIG. 3, FIG. 5 is an exploded perspective view illustrating the connection module and the airbag module in FIG. 3, FIG. 6 is a perspective view illustrating the connection module and the airbag module in FIG. 5, FIG. 7 is a perspective view illustrating an internal structure of a spherical bearing in the connection module of FIG. 5, FIG. 8 is a perspective view illustrating a combination structure of the driving module and the spherical bearing in FIG. 7, and FIG. 9 is a perspective view illustrating a combination structure of the lifting module and the spherical bearing in FIG. 7.

Referring to FIGS. 1 and 2, a conditioner 100 of this example embodiment may include an arm module 110, e.g., an arm, a lifting module 120, e.g., a lifter, a driving module 130, e.g., a driver, a disk module 140, e.g., a disk, a connection module 150, .g., a connector, and an airbag module 160, e.g., an airbag mechanism. The conditioner 100 may be controlled by controllers 116 and 190 that will be described in more detail below.

The disk module 140 may be arranged over a polishing pad configured to polish a layer on a substrate. The disk module 140 may include a conditioning disk 142 and a rotation shaft 144. The conditioning disk 142 may be arranged over the polishing pad. The conditioning disk 142 may be rotated and contacted with an upper surface of the polishing pad to polish the upper surface of the polishing pad. The rotation shaft 144 may connect the conditioning disk 142 with the driving module 130.

The driving module 130 may be connected to an upper surface of the conditioning disk 142 via the rotation shaft 144. The driving module 130 may transfer a rotary force to the conditioning disk 142 through the rotation shaft 144. In example embodiments, the driving module 130 may include a motor.

The lifting module 120 may be configured to vertically move the driving module 130. The lifting module 120 may transfer a vertical force to the disk module 140 through the driving module 130. Thus, the rotating conditioning disk 142 may pressurize the polishing pad. For example, the lifting module 120 may include a pneumatic cylinder. For example, the lifting module 120 may include a pair of cylinders arranged spaced apart from each other by a uniform gap.

The arm module 110 may be configured to rotate the lifting module 120 with respect to a vertical axis, e.g., around the Z axis. The arm module 110 may include an arm 112 connected to the lifting module 120, and an actuator 114 configured to rotate the arm 112 with respect to the vertical axis.

The arm 112 may be extended in a horizontal direction. The lifting module 120 may be connected to a first end of the arm 112, e.g., a left end of the arm 112 in FIG. 2. The actuator 114 may be connected to a second end (opposite the first end) of the arm 112, e.g., a right end of the arm 112 in FIG. 2. The actuator 114 may rotate the arm 112 with respect to the second end, e.g., the right end, of the arm 112. In example embodiments, the actuator 114 may include a motor.

The connection module 150 may be arranged between the lifting module 120 and the driving module 130. The connection module 150 may connect the driving module 130 with the lifting module 120 to allow a tilting of the driving module 130 with respect to the lifting module 120. For example, referring to FIGS. 3-4, each of the driving module 130 and the lifting module 120 may be connected to different parts of the connection module 150, so the driving module 130 and the lifting module 120 may be connected to each other via the connection module 150. For example, the driving module 130 may be tilted to a left direction or a right direction of a horizontal axis, e.g., X-axis, with respect to the lifting module 120 by the connection module 150, as will be described in more detail below with reference to FIGS. 3-9.

As illustrated in FIGS. 5-9, the connection module 150 may include a spherical bearing. The spherical bearing of the connection module 150 may include an outer ring 152 and an inner ring 154. The outer ring 152 may have an annular shape having an axial hole. The inner ring 154 may have an annular shape having an axial hole. The inner ring 154 may be tiltably received in the axial hole of the outer ring 152 with respect to the horizontal axis, e.g., the inner ring 154 may be tightly fitted within the axial hole of the outer ring 152 to be moveable with friction within the axial hole of the outer ring 152 with respect to the horizontal axis (e.g., an edge of the inner ring 154 may be tilted up along the Z axis relative to an opposite edge while the friction between the inner and outer rings 154 and 152 may maintain the inner ring 154 within the outer ring 152). For example, an outermost radius of the inner ring 154 may equal a radius of the axial hole of the outer ring 152 to have the inner ring 154 fit within the axial hole of the outer ring 152. Thus, the outermost radius of the inner ring 154 may be shorter than an outermost radius of the outer ring 152. For example, as illustrated in FIG. 7, the inner ring 154 may include a first portion 154*a* flush against an, e.g., entire, inner perimeter of the outer ring 152, and a second portion 154*b* extending radially from a bottom of the, e.g., entire, first portion 154*a* toward a center of the inner ring 154, e.g., the second portion 154*b* may be perpendicular to the first portion 154*a*. For example, as further illustrated in FIG. 7, the second portion 154*b* of the inner ring 154 may define the axial hole of the inner ring 154, e.g., a radius of the axial hole of the inner ring 154 may be smaller than an inner radius of the first portion 154*a* of the inner ring 154 by a length of the second portion 154*b* along the radial direction.

As illustrated in FIG. 8, the driving module 130 may be received in the axial hole of the inner ring 154. The driving module 130 may be fixed to the inner ring 154, e.g., to the second portion 154*b* of the inner ring 154. Thus, the driving module 130 may be interlocked with movements of the inner ring 154. That is, the driving module 130 may be tilted together with the tilting of the inner ring 154.

In contrast, as illustrated in FIG. 9, the lifting module 120 may be fixed to the outer ring 152. For example, the lifting module 120 may be fixed to an upper surface of the outer ring 152 at a side of the outer ring 152 that is between the driving module 130 and a center of the arm 112, i.e., the right portion of an upper surface of the outer ring 152 in FIGS. 2 and 9. In example embodiments, the lifting module 120 may be fixed to the upper surface of the outer ring 152 using a bracket 122, as illustrated in FIG. 9. The bracket 122 may have a lower surface configured to make contact with the, e.g., right portion of the, upper surface of the outer ring 152, and an upper surface fixed to the lifting module 120. Because the outer ring 152 may have a width, i.e., a difference between outer and inner radii of the outer ring 152, narrower than that of the lifting module 120, the upper surface of the bracket 122 may have a width wider than that of the lower surface of the bracket 122.

Therefore, because the lifting module 120 may be fixed to the outer ring 152 and the driving module 130 may be fixed to the inner ring 154, the tilting of the inner ring 154 in the outer ring 152 may be transferred only to the driving module 130, not to the lifting module 120. Thus, the tilting of the inner ring 154 in the outer ring 152 may generate the tilting of the driving module 130 with respect to the lifting module 120, while the lifting module 120 may remain stationary relative to the outer ring 152.

As illustrated in FIGS. 4-6, the connection module 150 may further include a lower extension plate 156 and an upper extension plate 158. As illustrated in FIG. 5, the lower extension plate 156 may be fixed to the lower surface of the outer ring 152. The lower extension plate 156 may have an outer diameter greater than that of the outer ring 152. Thus, the lower extension plate 156 may horizontally protrude from, e.g., beyond, an outer circumferential surface of the outer ring 152.

The upper extension plate 158 may be fixed to the upper surface of the inner ring 154, i.e., to the upper surface of the second portion 154*b* of the inner ring 154. The upper extension plate 158 may have an outer diameter greater than that of the outer ring 152. For example, the outer diameter of the upper extension plate 158 may be substantially the same as the outer diameter of the lower extension plate 156. In another example, the outer diameter of the upper extension plate 158 may be different from the outer diameter of the lower extension plate 156. The upper extension plate 158 may horizontally protrude from, e.g., beyond, the outer circumferential surface of the outer ring 152. Thus, an annular space 151 may be formed between portions of the lower and upper extension plates 156 and 158 that protrude beyond the outer circumferential surface of the outer ring 152 (FIG. 3). For example, the upper extension plate 158 may include a pair of plates. In another example, the upper extension plate 158 may include a single plate.

In example embodiments, as illustrated in FIGS. 5 and 6, each of the upper extension plates 158 may include a rim 158*a*, an upper fixing portion 158*b*, and a lower fixing portion 158*c*. The rim 158*a* may be located outside the outer circumferential surface of the outer ring 152 to form the annular space 151 together with the lower extension plate 156. The rim 158*a* may have an arc shape. The upper fixing portion 158*b* may be upwardly extended from an inner surface of the rim 158*a* (FIG. 6), e.g., openings 158*e* may be formed between the rim 158*a* and the upper fixing portion 158*b* to expose the outer ring 152 and accommodate the connection between the lifting module 120 and the outer ring 152. The lower fixing portion 158*c* may be downwardly extended from the inner surface of the rim 158*a* (FIG. 5). For example, the lower fixing portion 158*c* may be configured to make contact with the upper surface of the inner ring 154, e.g., the lower fixing portion 158*c* may directly contact the upper surface of the second portion 154*b* of the inner ring 154 (FIG. 6), while the rim 158*a* may extend over, e.g., may overhang, un uppermost surface of the outer ring 152 (FIG. 6), e.g., so the lifting module 120 may be fixed to the outer ring 152.

The upper fixing portion 158*b* and the lower fixing portion 158*c* may be positioned on a same vertical line, e.g., innermost edges of the upper fixing portion 158*b* and the lower fixing portion 158*c* facing a center of the rim 158*a* may be vertically aligned (FIG. 5). A fixing hole 158*d* may be vertically formed through the upper fixing portion 158*b* and the lower fixing portion 158*c*. The upper extension plates 158 may be fixed to the inner ring 154 by inserting a bolt into the fixing hole 158*d*. However, the upper extension plate 158 may have any other convenient shapes configured to form the annular space between the lower extension plate 156 and the upper extension plate 158.

As illustrated in FIG. 3, the airbag module 160 may be arranged in the annular space 151 between the upper extension plate 158 and the lower extension plate 156. The airbag module 160 may form at least two airbags between the lifting module 120 and the driving module 130. The at least two airbags between the lifting module 120 and the driving module 130 formed by the airbag module 160 may have different pressures. Thus, the airbag module 160 may form the airbags having different stiffnesses between the lifting module 120 and the driving module 130.

In detail, as illustrated in FIGS. 3 and 5, the airbag module 160 may include a first airbag block 162 and a second airbag block 164. Further, as illustrated in FIGS. 1-2, the airbag module 160 may include a first air line 192, a second air line 194, and a controller 190. The first air line 192 and the second air line 194 may be formed in the arm module 110, e.g., may extend through the arm 112 to contact the airbag module 160 (FIGS. 2 and 4).

Referring to FIGS. 3 and 5, the first airbag block 162 and the second airbag block 164 may be arranged in the annular space 151 between the upper extension plate 158 and the lower extension plate 156. For example, as illustrated in FIG. 3, the first and second airbag blocks 162 and 164 may, e.g., completely, fill the annular space 151 outside the outer ring 152 between the upper and lower extension plates 158 and 156. The first airbag block 162 and the second airbag block 164 may have substantially the same shape and size. Because the annular space 151 may have an annular shape, each of the first airbag block 162 and the second airbag block 164 may have an arc shape. In detail, the first and second airbag blocks 162 and 164 may have a curvature substantially the same as that of the outer ring 152. However, the first airbag block 162 and the second airbag block 164 may have other shapes, which may be received in the annular space 151, as well as the arc shape. Further, the first airbag block 162 and the second airbag block 164 may be arranged symmetrically relative to each other with respect to a center point of the outer ring 152. Thus, the first airbag block 162 and the second airbag block 164 may be arranged spaced apart from each other by a uniform gap. Further, the first airbag block 162 and the second airbag block 164 may include a flexible material. For example, the first airbag block 162 and the second airbag block 164 may include silicon, rubber, etc.

The first airbag block 162 may have a first airbag 161. The first airbag 161 may be formed in the first airbag block 162, e.g., the first airbag 161 may be an empty space within the first airbag block 162. The first air line 192 may be connected to the first airbag 161 to supply a first pneumatic pressure P1 to the first airbag 161, e.g., so the first air line 192 may control the amount of air (and corresponding pressure) within the empty space of the first airbag block 162 that is formed of flexible material. The first pneumatic pressure P1 transferred to the first airbag 161 through the first air line 192 may be controlled by the controller 190.

In example embodiments, the first airbag 161 may be exposed through an upper surface and a lower surface of the first airbag block 162, e.g., a shape of a bottom of the first airbag block 162 may be the same as a top thereof in FIG. 5. For example, in order to seal the first airbag 161, a lower cover 153 may be arranged on the lower surface of the first airbag block 162 and an upper cover 155 may be arranged on the upper surface of the first airbag block 162, e.g., upper surfaces of the lower cover 153 and first airbag block 162 may be level with each other or the lower cover 153 may completely cover the upper surface of the first airbag block 162. In another example, the lower cover 153 may be integrally formed with the lower extension plate 156 and the upper cover 155 may be integrally formed with the upper extension plate 158. If the first airbag 161 is not exposed through the upper surface and the lower surface of the first airbag block 162, the lower cover 153 and the upper cover 155 may not be provided on the first airbag block 162.

The second airbag block 164 may have a second airbag 163. The second airbag 163 may be formed in the second airbag block 164, e.g., e.g., the second airbag 163 may be an empty space within the second airbag block 164. The second airbag 163 may have a volume substantially the same as a volume of the first airbag 161. The second air line 194 may be connected to the second airbag 163 to supply a second pneumatic pressure P2 to the second airbag 163, e.g., so the second air line 194 may control the amount of air (and corresponding pressure) within the empty space of the second airbag block 164 that is formed of flexible material. The second pneumatic pressure P2 transferred to the second airbag 163 through the second air line 194 may be controlled by the controller 190.

In example embodiments, the second airbag 163 may be exposed through an upper surface and a lower surface of the second airbag block 164. For example, in order to seal the second airbag 163, the lower cover 153 may be arranged on the lower surface of the second airbag block 164 and the upper cover 155 may be arranged on the upper surface of the second airbag block 164. In another example, if the second airbag 163 is not exposed through the upper surface and the lower surface of the second airbag block 164, the lower cover 153 and the upper cover 155 may not be provided to the second airbag block 164.

The controller 190 may control the first pneumatic pressure P1 supplied to the first airbag 161, and the second pneumatic pressure P2 supplied to the second airbag 163. The first pneumatic pressure P1 in the first airbag 161 and the second pneumatic pressure P2 in the second airbag 163 may be substantially equal or different from each other. Thus, the controller 190 may provide the first airbag 161 with stiffness substantially equal to or different from stiffness of the second airbag 163. The pneumatic pressure controls of the controller 190 to the first and second airbags 161 and 163 may be determined in accordance with the tilting of the disk module 140. Further, the controller 190 may receive control signals from a main controller 116 for controlling operations of a CMP apparatus including the conditioner 100.

For example, the airbag module 160 may include the first and second airbag blocks 162 and 164 connected to the first and second air lines 192 and 194, respectively. In another example, the airbag module 160 may include at least three airbag blocks connected to respective three different air lines.

Additionally, as illustrated in FIG. 2, the conditioner 100 may further include a load cell 170. The load cell 170 may measure loads applied to the disk module 140 from the lifting module 120. That is, the load cell 170 may measure conditioning forces applied to the polishing pad from the conditioner 100. The loads measured by the load cell 170 may be transmitted to the controller 190. In order to optimally condition the polishing pad by the conditioner 100, the controller 190 may control the pneumatic pressures applied to the first and second airbags 161 and 163 and the loads applied to the disk module 140.

Further, the conditioner 100 may further include an angle sensor module 180. The angle sensor module 180 may measure a tilted angle of the driving module 130 with respect to the lifting module 120. In example embodiments, as illustrated in FIG. 9, the angle sensor module 180 may include a bracket 182 and an angle sensor 184. The bracket 182 may be installed at the upper surface of the upper extension plate 158. Thus, the bracket 182 may be interlocked with the tilting of the inner ring 154. The angle sensor 184 may be mounted on the bracket 182. Because the bracket 182 may be tilted together with the inner ring 154, the angle sensor 184 may measure the tilted angle of the driving module 130. The tilted angle of the driving module 130 measured by the angle sensor 184, i.e., the tilted angle of the disk module 140, may be transmitted to the controller 190.

Figure 10:
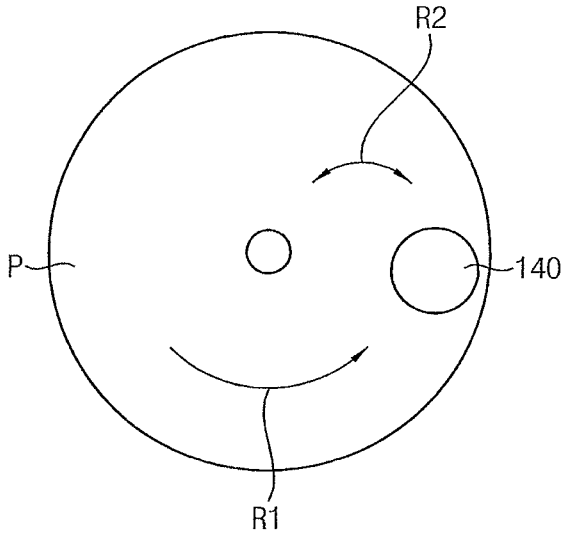
FIG. 10 illustrates a plan view of rotation directions of the disk module and a polishing pad.
Figure 11:
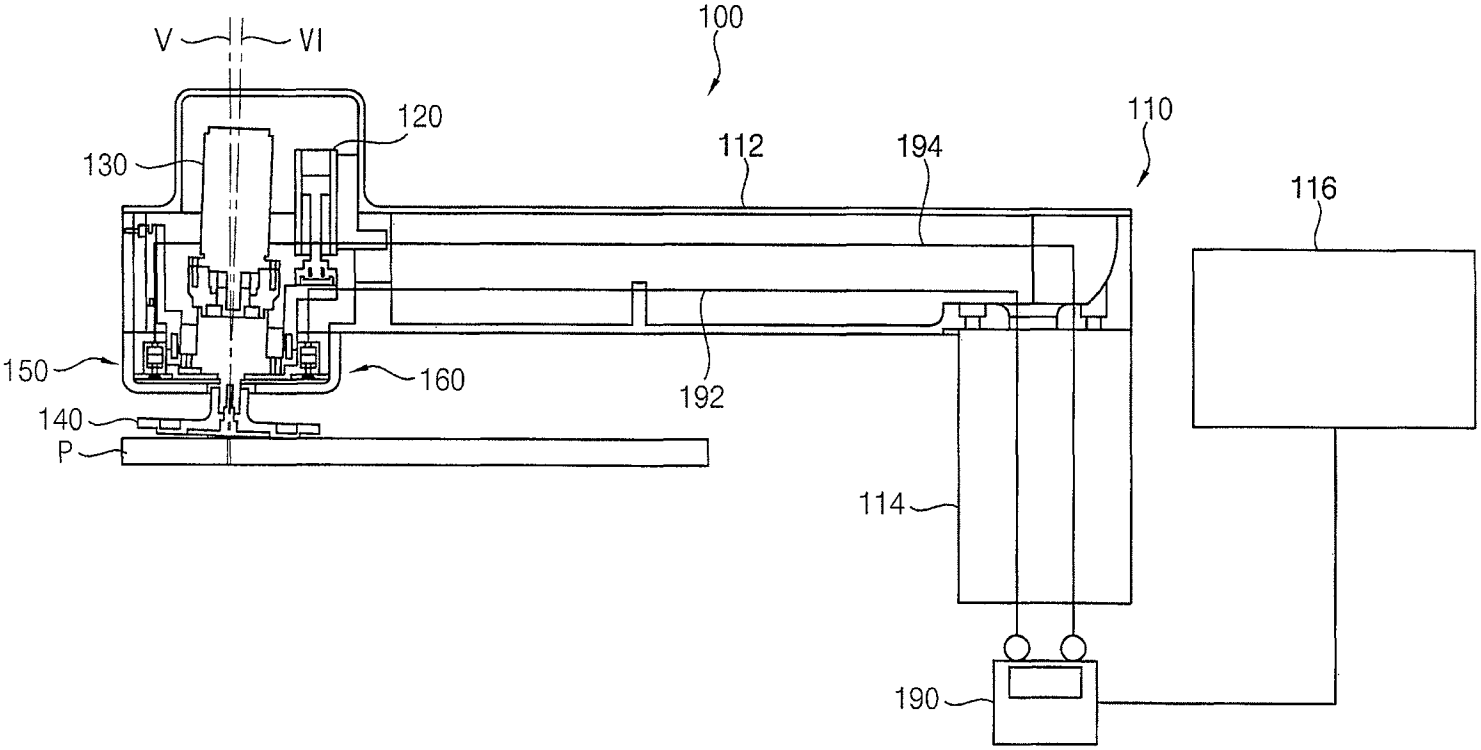
FIG. 11 illustrates a cross-sectional view of the tilted disk module of the conditioner in FIG. 1.
Figure 12:
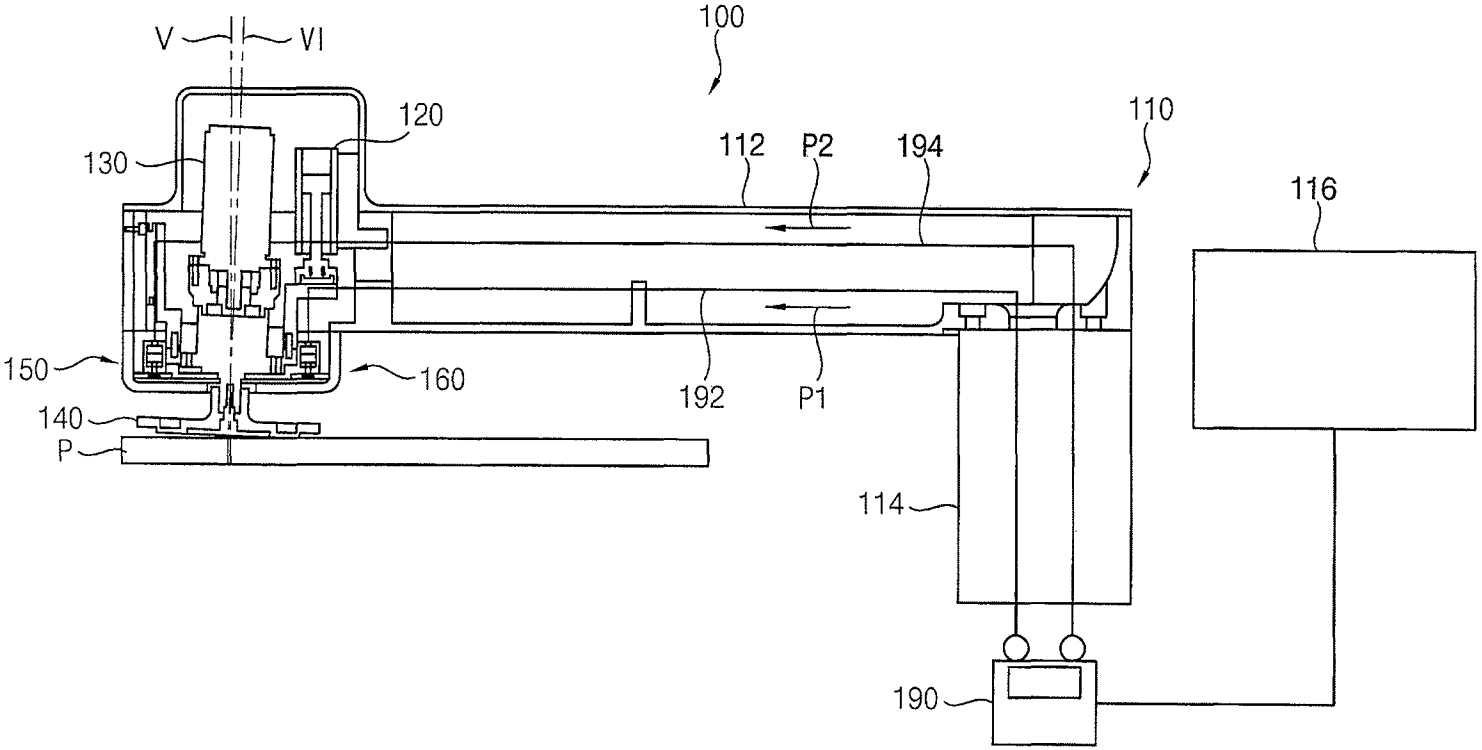
FIG. 12 illustrates a cross-sectional view of operations of the airbag module for correcting the tilting of the disk module in FIG. 11.
Figure 13:
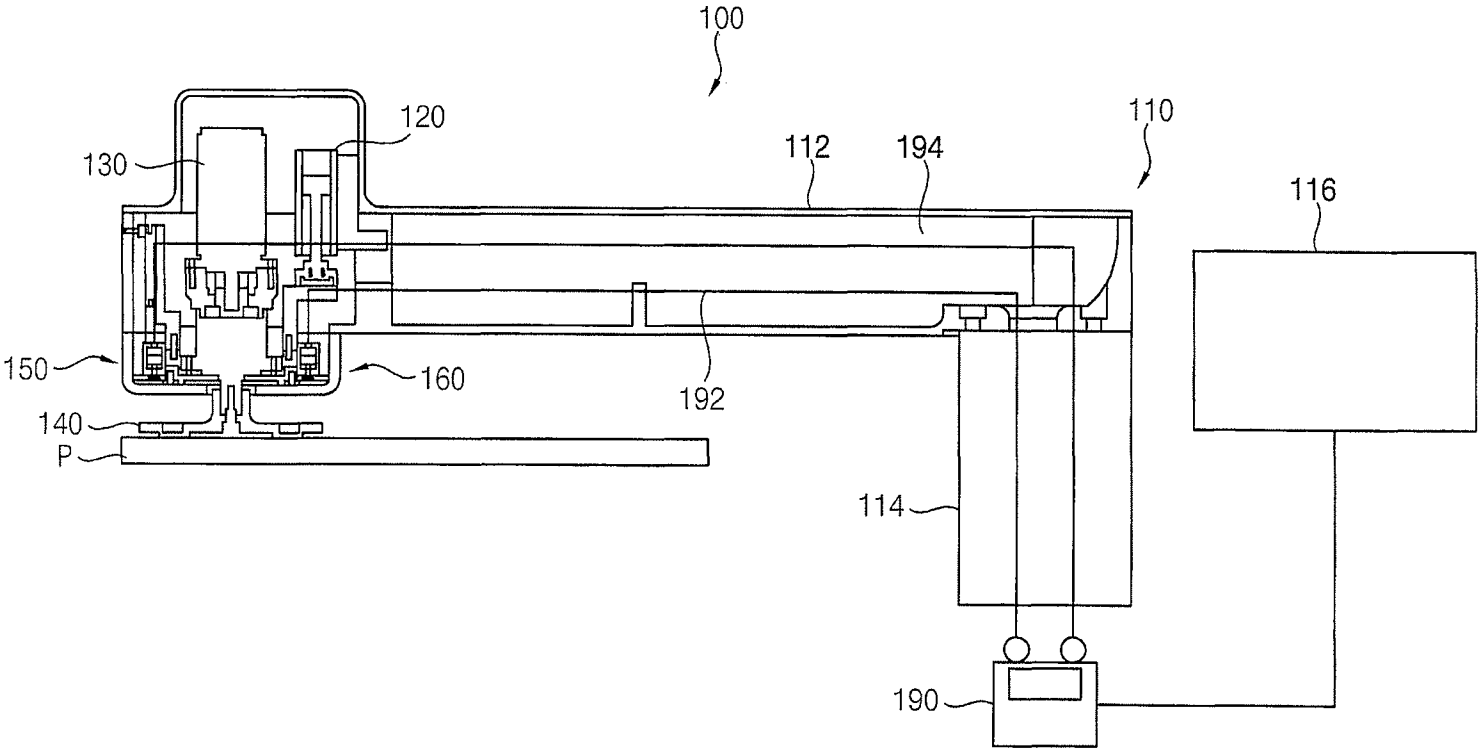
FIG. 13 illustrates a cross-sectional view of a corrected disk module by the airbag module in FIG. 12.

FIG. 10 is a plan view illustrating rotation directions of the disk module 140 and a polishing pad, FIG. 11 is a cross-sectional view illustrating the tilted disk module 140 in the conditioner 100, FIG. 12 is a cross-sectional view illustrating operations of the airbag module 160 for correcting the tilting of the disk module 140 in FIG. 11, and FIG. 13 is a cross-sectional view illustrating a corrected disk module 140 by the airbag module 160.

Referring to FIG. 10, when the disk module 140 is rotated in an R2 direction and a polishing pad P is rotated in an R1 direction, a friction may be generated between the disk module 140 and the polishing pad P. Thus, as shown in FIG. 11, the disk module 140 may be tilted with respect to an upper surface of the polishing pad P relative to the vertical axis V due to a lateral force generated by the friction between the disk module 140 and the polishing pad P.

For example, referring to FIG. 11, the tilted disk module 140 may have a rotation axis V1 right tilted with respect to the vertical axis V. Thus, a left portion of the disk module 140 under the first airbag block 162 may be slightly floated from the upper surface of the polishing pad P. In this case, a pressure applied to the polishing pad P from the left portion of the disk module 140 (i.e., the slightly floated portion) may be lower than a pressure applied to the polishing pad P from a right portion of the disk module 140 (i.e., the portion directly on the polishing pad P). The load cell 170 (FIG. 2)

may measure a pressure difference between the pressure applied to the polishing pad P by the right and left portions of the disk module 140, and the angle sensor module 180 may measure the tilted angle of the disk module 140. The pressure difference measured by the load cell 170 and the tilted angle of the disk module 140 measured by the angle sensor module 180 may be transmitted to the controller 190.

Referring to FIG. 12, the controller 190 may set the pneumatic pressure applied to each of the first and second airbags 161 and 163 in accordance with the measured pressure difference and the tilted angle. That is, referring to FIG. 11, if the left portion of the disk module 140 under the first airbag block 162 is floated and exerts lower pressure on the polishing pad P than the right portion of the disk module 140, the controller 190 may set the first pneumatic pressure P1 applied to the first airbag 161 in the first airbag block 162 higher than the second pneumatic pressure P2 applied to the second airbag 163 in the second airbag block 164 to adjust the reduced pressure exerted by the first airbag block 162. Therefore, because the first pneumatic pressure P1 applied to the left portion of the disk module 140 under the first airbag 161 may be higher than the second pneumatic pressure P2 applied to the right portion of the disk module 140 under the second airbag 163, the tilting of the disk module 140 may be corrected (FIG. 13). As a result, the disk module 140 may condition the polishing pad P using a uniform pressure.

Figure 14:
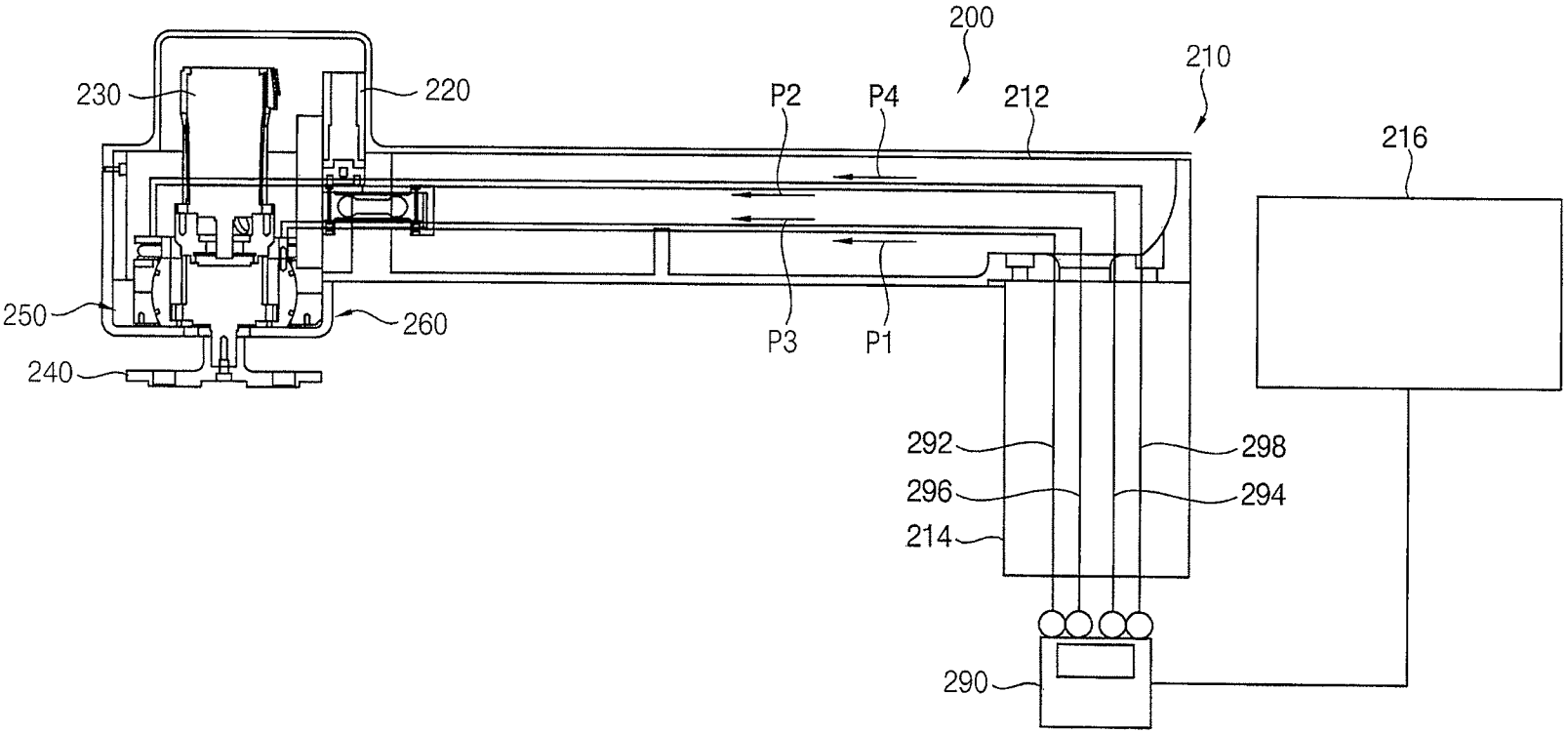
FIG. 14 illustrates a cross-sectional view of a conditioner in accordance with example embodiments.
Figure 15:
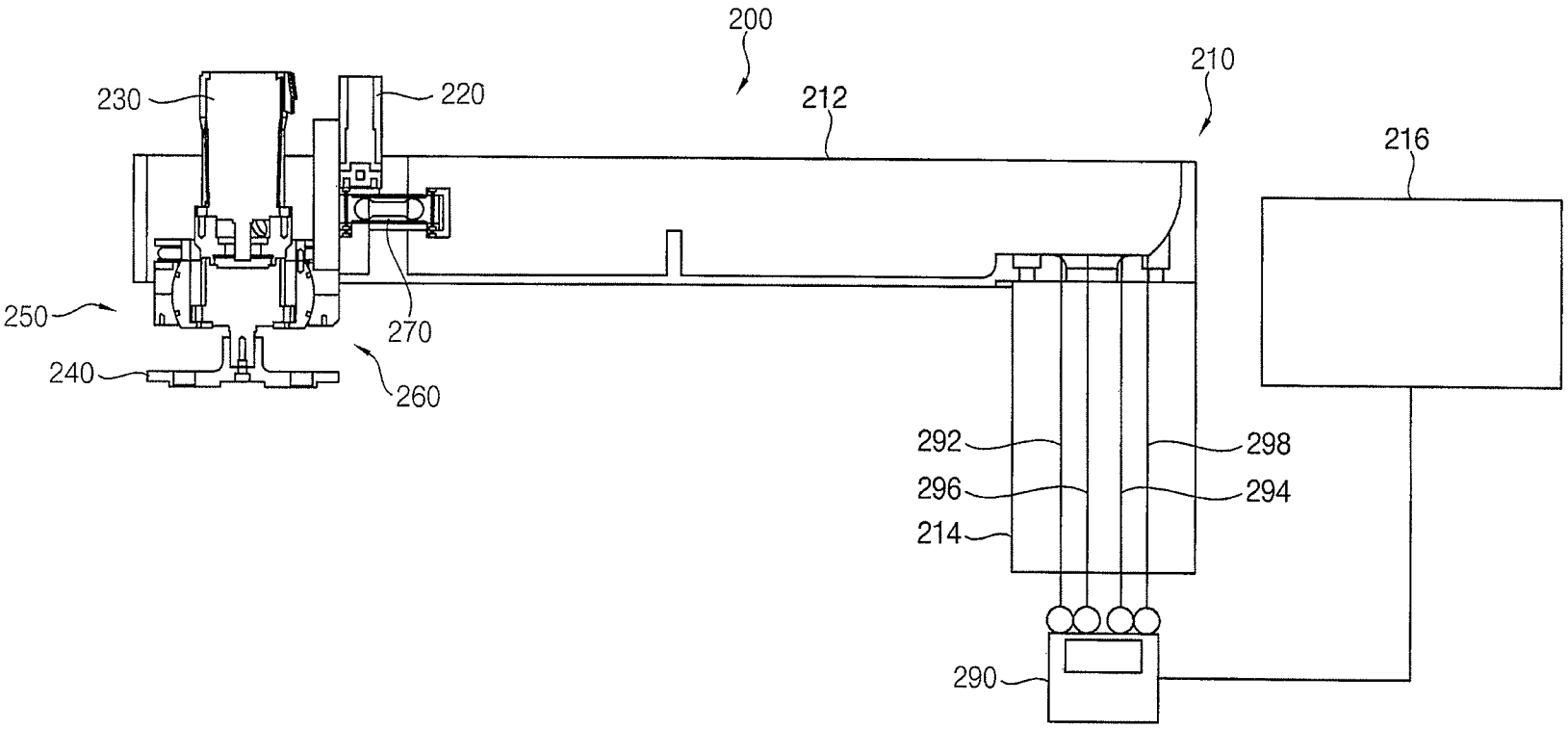
FIG. 15 illustrates a cross-sectional view of an internal structure of the conditioner in FIG. 14.
Figure 16:
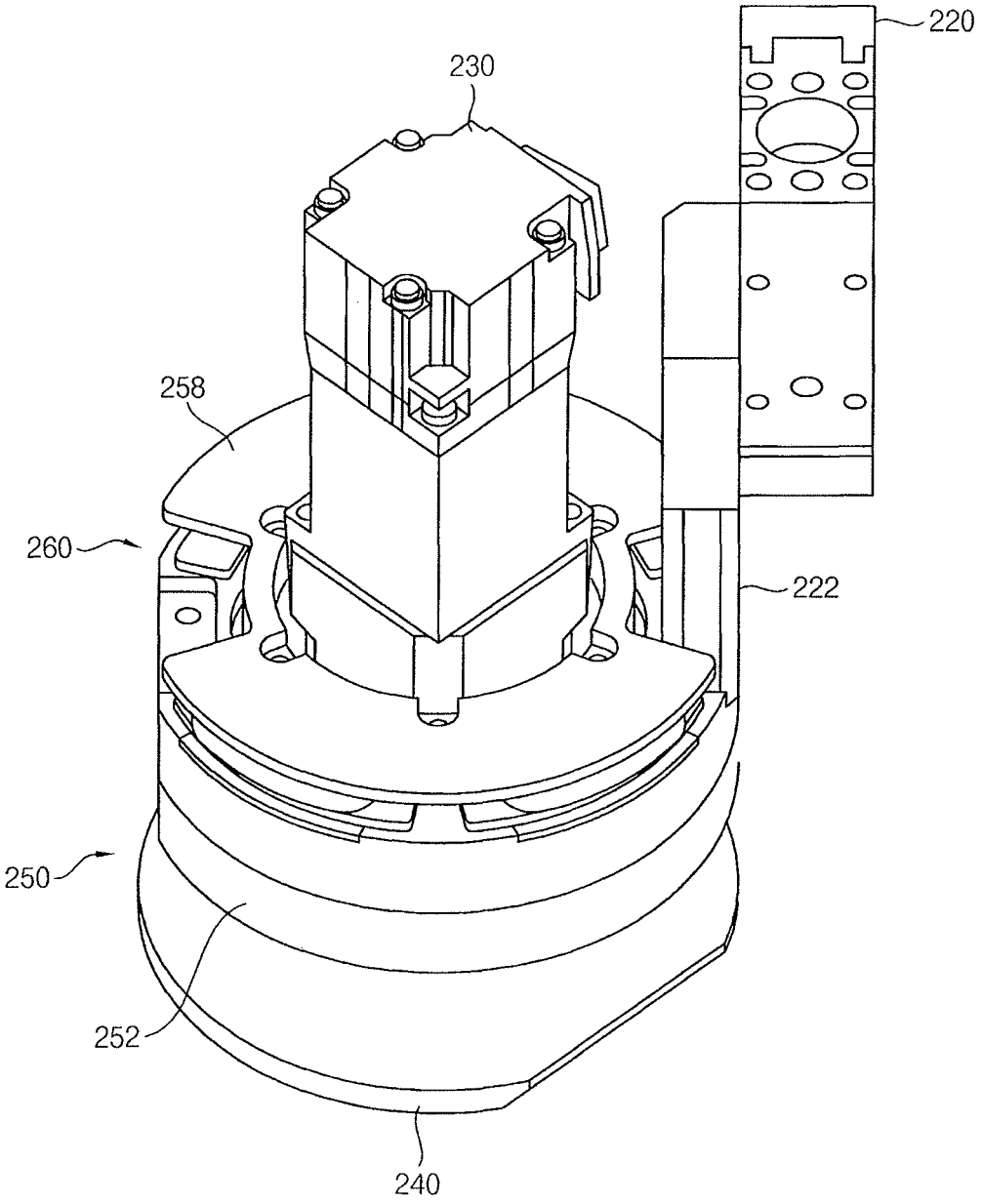
FIG. 16 illustrates a perspective view of a combination structure of a lifting module, a driving module, a connection module and an airbag module in the conditioner of FIG. 14.
Figure 17:
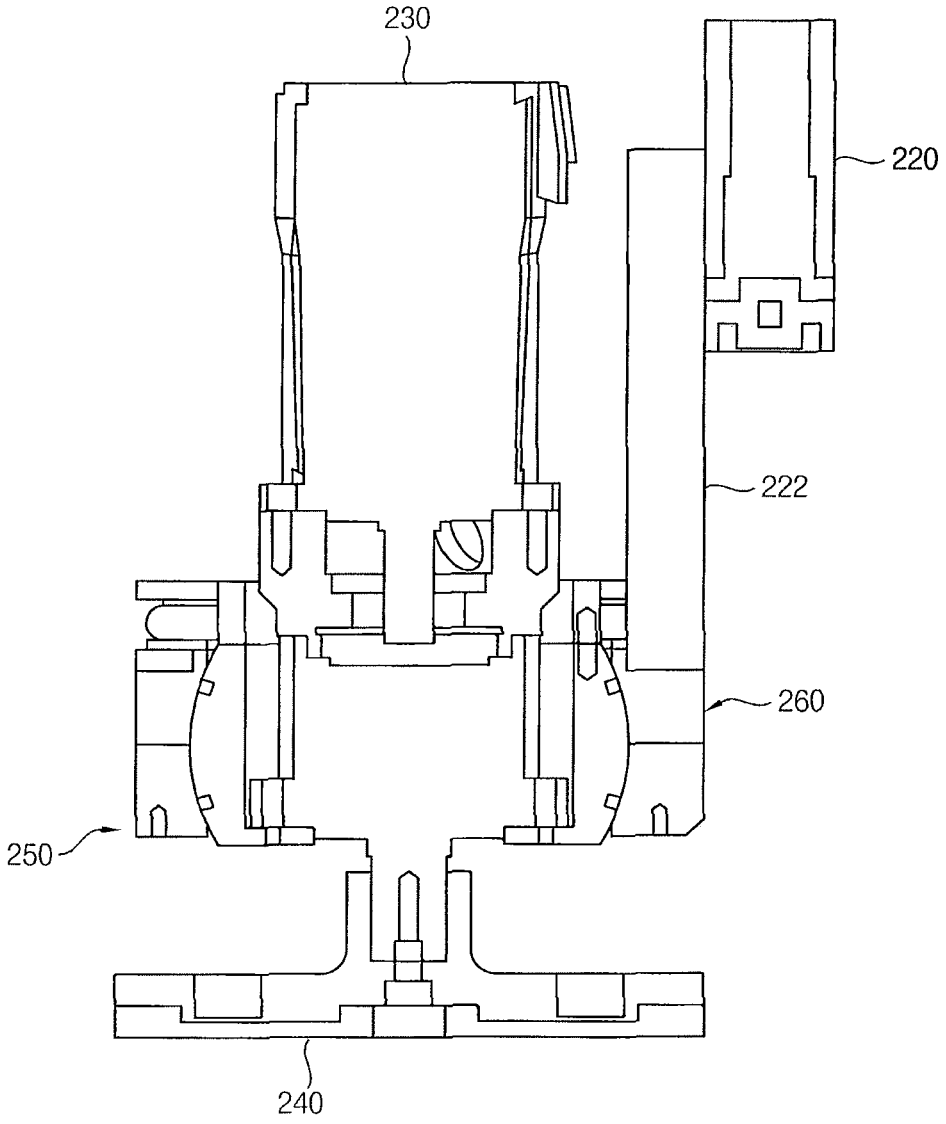
FIG. 17 illustrates a cross-sectional view of the combination structure of the lifting module, the driving module, the connection module and the airbag module in FIG. 16.
Figure 18:
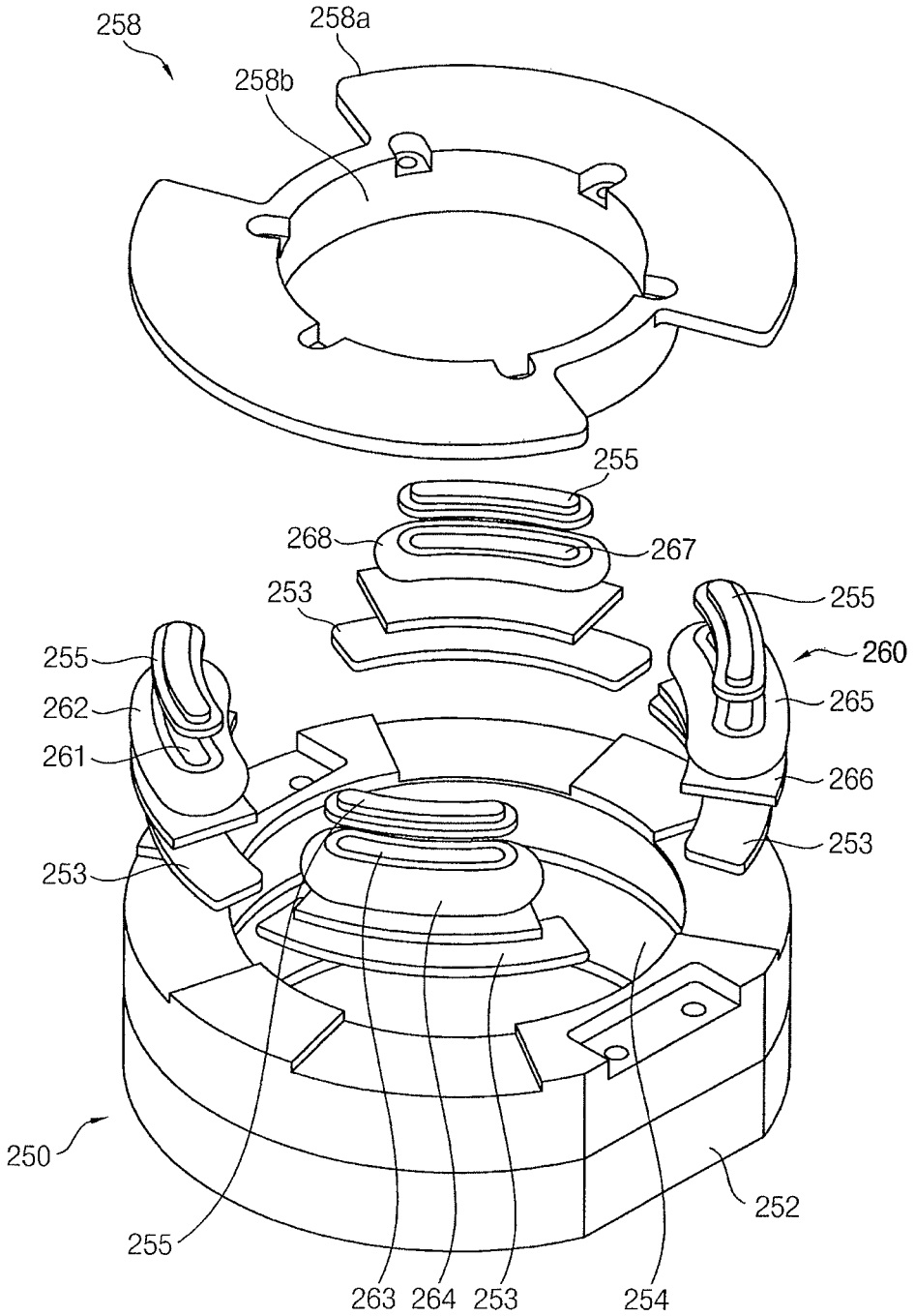
FIG. 18 illustrates an exploded perspective view of the connection module and the airbag module in FIG. 16.
Figure 19:
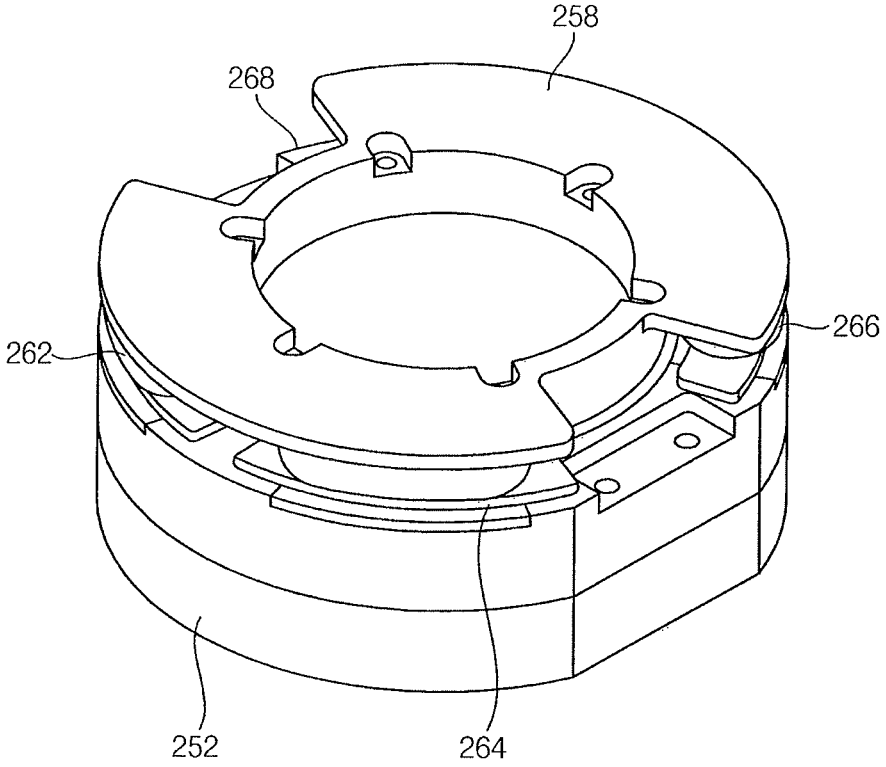
FIG. 19 illustrates a perspective view of the connection module and the airbag module in FIG. 18.
Figure 20:
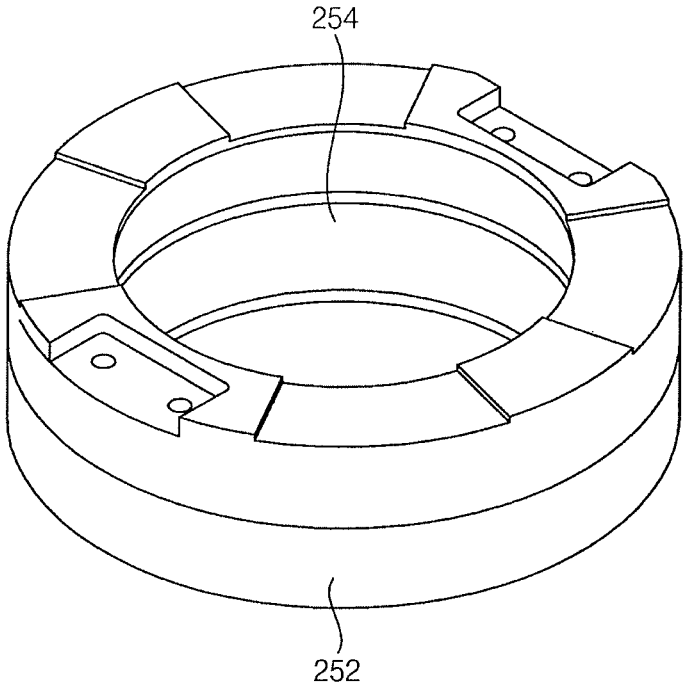
FIG. 20 illustrates a perspective view of an internal structure of a spherical bearing in the connection module of FIG. 18.
Figure 21:
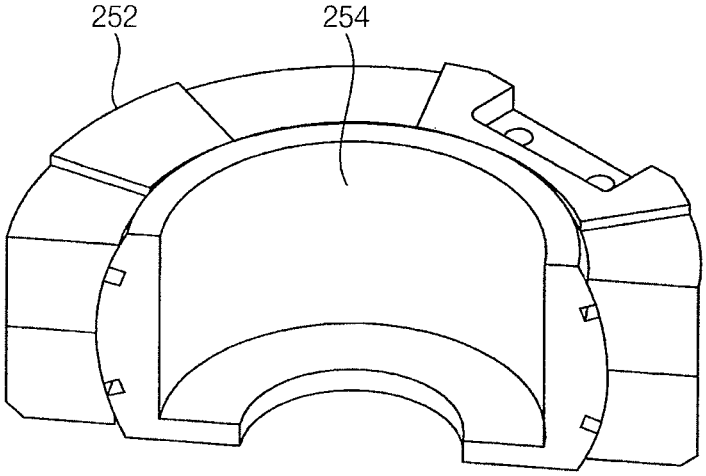
FIG. 21 illustrates a perspective view of a combination structure of the driving module and the spherical bearing in FIG. 20.
Figure 22:
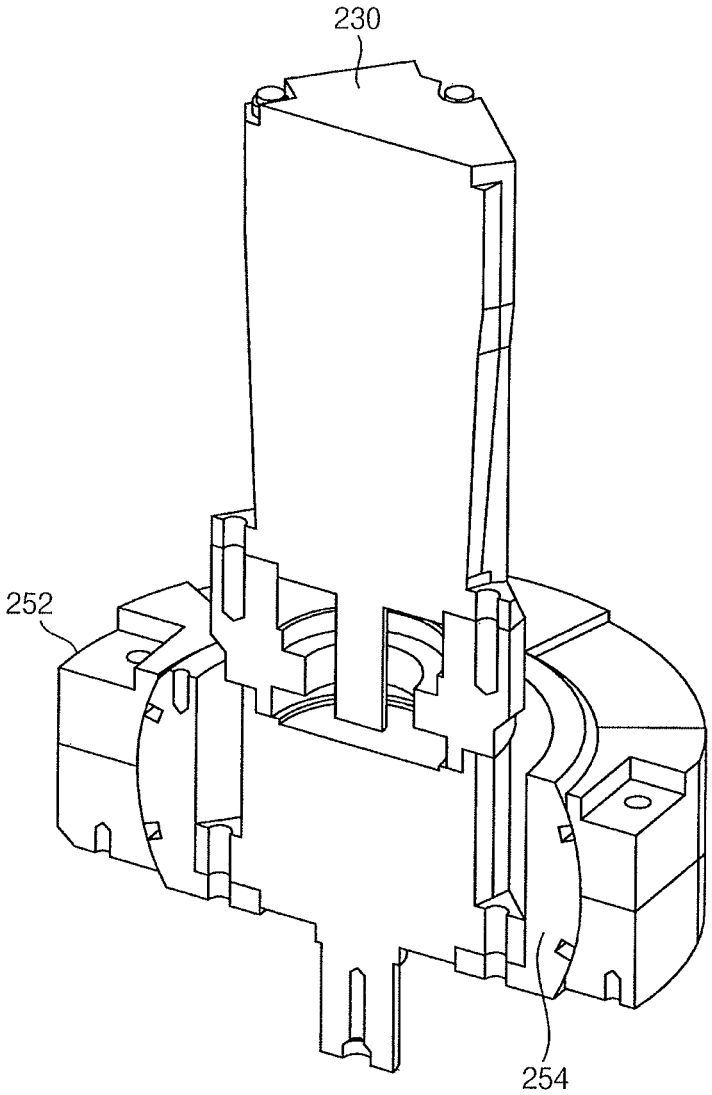
FIG. 22 illustrates a perspective view of a combination structure of the driving module and the spherical bearing in FIG. 20.
Figure 23:
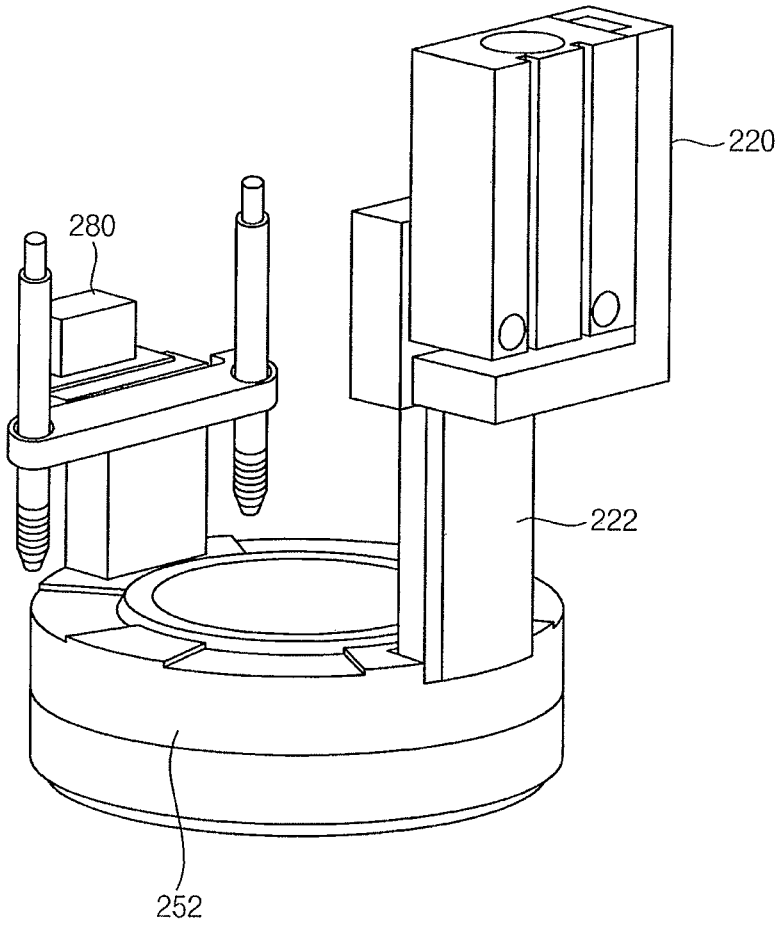
FIG. 23 illustrates a perspective view of a combination structure of the lifting module and the spherical bearing in FIG. 20.

FIG. 14 is a cross-sectional view illustrating a conditioner in accordance with example embodiments, FIG. 15 is a cross-sectional view illustrating an internal structure of the conditioner in FIG. 14, FIG. 16 is a perspective view illustrating a combination structure of a lifting module, a driving module, a connection module and an airbag module in the conditioner of FIG. 14, FIG. 17 is a cross-sectional view illustrating the combination structure of the lifting module, the driving module, the connection module and the airbag module in FIG. 16, FIG. 18 is an exploded perspective view illustrating the connection module and the airbag module in FIG. 16, FIG. 19 is a perspective view illustrating the connection module and the airbag module in FIG. 18, FIG. 20 is a perspective view illustrating an internal structure of a spherical bearing in the connection module of FIG. 18, FIG. 21 is a perspective view illustrating a combination structure of the driving module and the spherical bearing in FIG. 20, FIG. 22 is a perspective view illustrating a combination structure of the driving module and the spherical bearing in FIG. 20, and FIG. 23 is a perspective view illustrating a combination structure of the lifting module and the spherical bearing in FIG. 20.

Referring to FIGS. 14 to 23, a conditioner 200 of this example embodiment may include an arm module 210, a lifting module 220, a driving module 230, a disk module 240, a connection module 250, and an airbag module 260.

The arm module 210, the lifting module 220, the driving module 230, and the disk module 240 in accordance with this example embodiment may have structures and functions substantially the same as those of the arm module 110, the lifting module 120, the driving module 130, and the disk module 140 in FIG. 1, respectively. Thus, any further illustrations with respect to the arm module 210, the lifting module 220, the driving module 230, and the disk module 240 in accordance with this example embodiment will be omitted herein for brevity.

The connection module 250 may be arranged between the lifting module 220 and the driving module 230. The connection module 250 may connect the driving module 230 with the lifting module 220 to allow a tilting of the driving module 230 with respect to the lifting module 220. Particularly, the driving module 230 may be tilted to a left direction or a right direction of a horizontal axis with respect to the lifting module 220 by the connection module 250.

The connection module 250 may include a spherical bearing. The spherical bearing may include an outer ring 252 and an inner ring 254. The outer ring 252 may have an annular shape having an axial hole. The inner ring 254 may have an annular shape having an axial hole. The inner ring 254 may be tiltably received in the axial hole of the outer ring 252 with respect to the horizontal axis. Thus, the inner ring 254 may have an outer diameter shorter than that of the outer ring 252.

In example embodiments, the outer diameter of the outer ring 252 may be shorter than the outer diameter of the outer ring 152 in FIG. 5. Further, the outer ring 252 may have a thickness greater than that of the outer ring 152 in FIG. 5. Thus, the outer ring 252 may have a width greater than that of the outer ring 152 in FIG. 5. As a result, the outer ring 252 may have stiffness greater than that of the outer ring 152 in FIG. 5.

The driving module 230 may be received in the axial hole of the inner ring 254. The driving module 230 may be fixed to the inner ring 254. Thus, the driving module 230 may be interlocked with movements of the inner ring 254. That is, the driving module 230 may be tilted together with the tilting of the inner ring 254.

In contrast, the lifting module 220 may be fixed to the outer ring 252. Particularly, the lifting module 220 may be fixed to a right portion of an upper surface of the outer ring 252. In example embodiments, the lifting module 220 may be fixed to the right portion of the upper surface of the outer ring 252 using a bracket 222. The bracket 222 may have a lower surface configured to make contact with the right portion of the upper surface of the outer ring 252, and an upper surface to which the lifting module 220 may be fixed. Because the width of the outer ring 252 may be greater than the width of the outer ring 152 in FIG. 5, the bracket 222 may have a uniform width. That is, a width of the upper surface of the bracket 222 may be substantially the same as a width of the lower surface of the bracket 222

Therefore, because the lifting module 220 may be fixed to the outer ring 252 and the driving module 230 may be fixed to the inner ring 254, the tilting of the inner ring 254 in the outer ring 252 may be transferred to only the driving module 230, not the lifting module 220. Thus, the tilting of the inner ring 254 in the outer ring 252 may generate the tilting of the driving module 230 with respect to the lifting module 220.

The connection module 250 may further include an extension plate 258. The extension plate 258 may be fixed to the upper surface of the inner ring 254. The extension plate 258 may have an outer diameter greater than that of the inner ring 254. The outer diameter of the extension plate 258 may be substantially the same as the outer diameter of the outer ring 252. Alternatively, the outer diameter of the extension plate 258 may be different from the outer diameter of the outer ring 252. Thus, an annular space may be formed between the extension plates 258 and the outer ring 252.

In example embodiments, the extension plate 258 may include a rim **258*a* and a fixing portion 258*b*. The rim 258*a* may be located over the outer ring 252 to form the annular space together with the outer ring 252. The rim 258*a* may include a pair or rims having an arc shape. The fixing portion 258*b* may be downwardly extended from an inner surface of the rim 258*a*. The fixing portion 258*b* may be fixed to the upper surface of the inner ring 254. Alternatively, the extension plate 258 may have other shapes configured to form the annular space between the extension plate 258 and the outer ring 252**.

The airbag module 260 may be arranged in the space between the outer ring 252 and the extension plate 258. The airbag module 260 may form at least two airbags between the lifting module 220 and the driving module 230. Particularly, the at least two airbags between the lifting module 220 and the driving module 230 formed by the airbag module 260 may have different pressures. Thus, the airbag module 260 may form the airbags having different stiffnesses between the lifting module 220 and the driving module 230.

The airbag module 260 may include a first airbag block 262, a second airbag block 264, a third airbag block 266, a fourth airbag block 268, a first air line 292, a second air line 294, a third air line 296, a fourth air line 298, and a controller 290. The first air line 292, the second air line 294, the third air line 296, and the fourth air line 298 may be formed in the arm module 210.

The first to fourth airbag blocks 262, 264, 266, and 268 may be arranged in the space between the extension plate 258 and the outer ring 252. The first to fourth airbag blocks 262, 264, 266, and 268 may have substantially the same shape and size. Because the space may have the annular shape, the first to fourth airbag blocks 262, 264, 266, and 268 may have an arc shape. However, the first to fourth airbag blocks 262, 264, 266, and 268 may have other shapes, which may be received in the space, as well as the arc shape. Further, the first to fourth airbag blocks 262, 264, 266, and 268 may be arranged symmetrically with each other relative to a center point of the outer ring 252. Thus, the first to fourth airbag blocks 262, 264, 266, and 268 may be arranged spaced apart from each other by a uniform gap. Further, the first to fourth airbag blocks 262, 264, 266 and 268 may include a flexible material. For example, the first to fourth airbag blocks 262, 264, 266, and 268 may include silicon, rubber, etc.

The first airbag block 262 may have a first airbag 261. The first airbag 261 may be formed in the first airbag block 262. The first air line 292 may be connected to the first airbag 261 to supply a first pneumatic pressure P1 to the first airbag 261. The first pneumatic pressure P1 transferred to the first airbag 261 through the first air line 292 may be controlled by the controller 290.

In example embodiments, the first airbag 261 may be exposed through an upper surface and a lower surface of the first airbag block 262. In order to seal the first airbag 261, a lower cover 253 may be arranged on the lower surface of the first airbag block 262 and an upper cover 255 may be arranged on the upper surface of the first airbag block 262. Alternatively, the upper cover 255 may be integrally formed with the extension plate 258. In contrast, when the first airbag 261 may not be exposed through the upper surface and the lower surface of the first airbag block 262, the lower cover 253 and the upper cover 255 may not be provided to the first airbag block 262.

The second airbag block 264 may have a second airbag 263. The second airbag 263 may be formed in the second airbag block 264. The second airbag 263 may have a volume substantially the same as a volume of the first airbag 261. The second air line 294 may be connected to the second airbag 263 to supply a second pneumatic pressure P2 to the second airbag 263. The second pneumatic pressure P2 transferred to the second airbag 263 through the second air line 294 may be controlled by the controller 290.

In example embodiments, the second airbag 263 may be exposed through an upper surface and a lower surface of the second airbag block 264. In order to seal the second airbag 263, the lower cover 253 may be arranged on the lower surface of the second airbag block 264 and the upper cover 255 may be arranged on the upper surface of the second airbag block 264. In contrast, when the second airbag 263 may not be exposed through the upper surface and the lower surface of the second airbag block 264, the lower cover 253 and the upper cover 255 may not be provided to the second airbag block 264.

The third airbag block 266 may have a third airbag 265. The third airbag 265 may be formed in the third airbag block 266. The third airbag 265 may have a volume substantially the same as the volume of the first airbag 261. The third air line 296 may be connected to the third airbag 265 to supply a third pneumatic pressure P3 to the third airbag 265. The third pneumatic pressure P3 transferred to the third airbag 265 through the third air line 296 may be controlled by the controller 290.

In example embodiments, the third airbag 265 may be exposed through an upper surface and a lower surface of the third airbag block 266. In order to seal the third airbag 265, the lower cover 253 may be arranged on the lower surface of the third airbag block 266 and the upper cover 255 may be arranged on the upper surface of the third airbag block 266. Alternatively, the upper cover 255 may be integrally formed with the extension plate 258. In contrast, when the third airbag 265 may not be exposed through the upper surface and the lower surface of the third airbag block 266, the lower cover 253 and the upper cover 255 may not be provided to the third airbag block 266.

The fourth airbag block 268 may have a fourth airbag 267. The fourth airbag 267 may be formed in the fourth airbag block 268. The fourth airbag 267 may have a volume substantially the same as the volume of the first airbag 261. The fourth air line 298 may be connected to the fourth airbag 267 to supply a fourth pneumatic pressure P4 to the fourth airbag 267. The fourth pneumatic pressure P4 transferred to the fourth airbag 267 through the fourth air line 298 may be controlled by the controller 290.

In example embodiments, the fourth airbag 267 may be exposed through an upper surface and a lower surface of the fourth airbag block 268. In order to seal the fourth airbag 267, the lower cover 253 may be arranged on the lower surface of the fourth airbag block 268 and the upper cover 255 may be arranged on the upper surface of the fourth airbag block 268. In contrast, when the fourth airbag 267 may not be exposed through the upper surface and the lower surface of the fourth airbag block 268, the lower cover 253 and the upper cover 255 may not be provided to the fourth airbag block 268.

The controller 290 may control the first to fourth pneumatic pressures P1, P2, P3 and P4 supplied to the first to fourth airbags 261, 263, 265 and 267. The first pneumatic pressure P1 in the first airbag 261, the second pneumatic pressure P2 in the second airbag 263, the third pneumatic pressure P3 in the third airbag 265 and the fourth pneumatic pressure P4 in the fourth airbag 267 may be substantially equal to or different from each other. Thus, the controller 290 may provide the first to fourth airbags 261, 263, 265 and 267 with substantially equal stiffness or different stiffnesses. The pneumatic pressure controls of the controller 290 to the first to fourth airbags 261, 263, 265 and 267 may be determined in accordance with the tilting of the disk module 240. Further, the controller 290 may receive control signals from a main controller 216 for controlling operations of a CMP apparatus including the conditioner 200.

In example embodiments, the airbag module 260 may include the four airbag blocks 262, 264, 266 and 268. Alternatively, the airbag module 260 may include two, three or at least five airbag blocks.

Additionally, the conditioner 200 may further include a load cell 270. The load cell 270 may measure loads applied to the disk module 240 from the lifting module 220. The loads measured by the load cell 270 may be transmitted to the controller 290. In order to optimally condition the polishing pad by the conditioner 200, the controller 290 may control the pneumatic pressures applied to the first to fourth airbags 261, 263, 265 and 267 and the loads applied to the disk module 240.

Further, the conditioner 200 may further include an angle sensor module 280. The angle sensor module 280 may measure a tilted angle of the driving module 230 with respect to the lifting module 220. The tilted angle of the driving module 230 measured by the angle sensor module 280, i.e., the tilted angle of the disk module 240 may be transmitted to the controller 290.

CMP Apparatus

Figure 24:
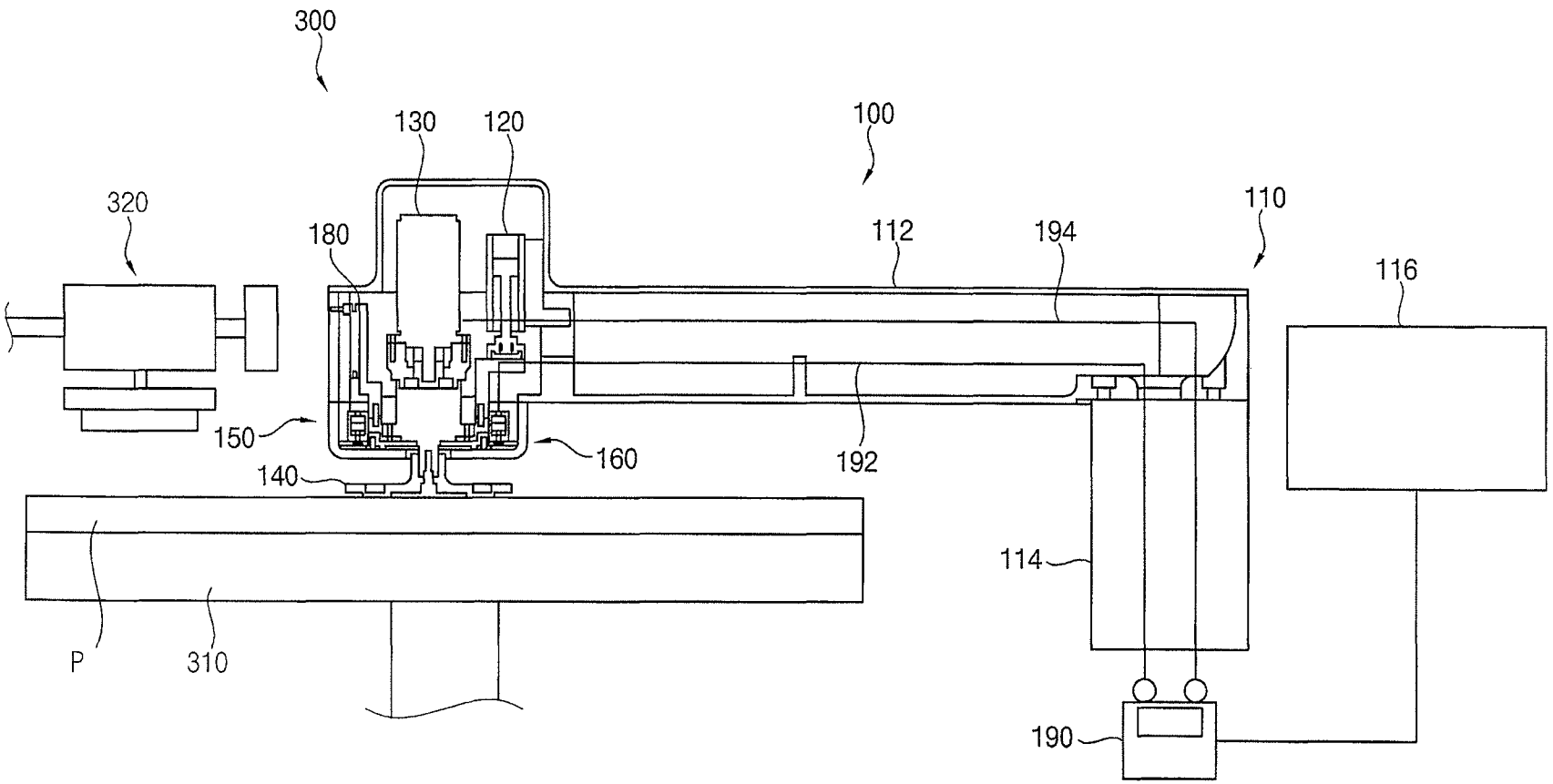
FIG. 24 illustrates a cross-sectional view of a CMP apparatus including the conditioner in FIG. 1.

FIG. 24 is a cross-sectional view illustrating a CMP apparatus including the conditioner 100 in FIG. 1.

Referring to FIG. 24, a CMP apparatus 300 of this example embodiment may include a platen 310, a CMP mechanism 320, and the conditioner 100. Operations of the CMP apparatus 300 may be controlled by the main controller 116.

In example embodiments, the conditioner 100 of this example embodiment may include elements substantially the same as those described previously with reference to FIG. 1. Thus, the same reference numerals may refer to the same elements and any further illustrations with respect to the same elements are omitted herein for brevity. Alternatively, the CMP apparatus 300 may include the conditioner 200 in FIG. 14.

Referring to FIG. 24, the polishing pad P may be arranged on an upper surface of the platen 310. The CMP mechanism 320 may contact a layer on a substrate with the polishing pad P to chemically mechanically polish the layer using slurry.

The conditioner 100 may be arranged over the polishing pad P. The conditioner 100 may contact the rotating disk module 140 with the rotating polishing pad P to condition the polishing pad P.

Particularly, the arm module 110 may rotate the lifting module 120, the driving module 130, the disk module 140, the connection module 150, and the airbag module 160 to position the disk module 140 over a conditioned region of the polishing pad P. The lifting module 120 may downwardly move the driving module 130, the disk module 140, the connection module 150, and the airbag module 160 toward the polishing pad P to contact the disk module 140 with the polishing pad P. The driving module 130 may rotate the disk module 140. Thus, the rotating disk module 140 may pressurize the polishing pad P to condition the polishing pad P.

During the conditioning process, the driving module 130 may be tilted with respect to the lifting module 120 by the connection module 150. Particularly, because the airbag module 160 may include the at least two airbags in the connection module 150, the deformations of the connection module 150 may be buffered by the airbags. Thus, the connection module 150 may have improved durability with respect to the fatigue failure caused by the friction between the polishing pad P and the disk module 140.

Further, the load cell 170 may measure the load applied to the disk module 140 from the lifting module 120. The load measured by the load cell 170 may be transmitted to the controller 190. The angle sensor module 180 may measure the tilted angle of the driving module 130 with respect to the lifting module 120. The tilted angle of the driving module 130 measured by the angle sensor module 180, i.e., the tilted angle of the disk module 140 may be transmitted to the controller 190.

The controller 190 may control the first and second pneumatic pressures P1 and P2 supplied to the first and second airbags 161 and 163, respectively, in accordance with the loads and the tilted angle. Particularly, the controller 190 may provide the first and second airbags 161 and 163 with the different pneumatic pressures in accordance with the tilted angle of the disk module 140 measured by the angle sensor module 180 to correct the tilting of the disk module 140. Further, the conditioning force applied to the polishing pad P from the disk module 140 may correspond to a sum of the load of the lifting module 120 and the pressures in the first and second airbags 161 and 163. Therefore, the controller 190 may selectively control the pneumatic pressures in the first and second airbags 161 and 163 to provide the disk module 140 with an optical conditioning force.

Method of Manufacturing a Semiconductor Device

Figure 25:
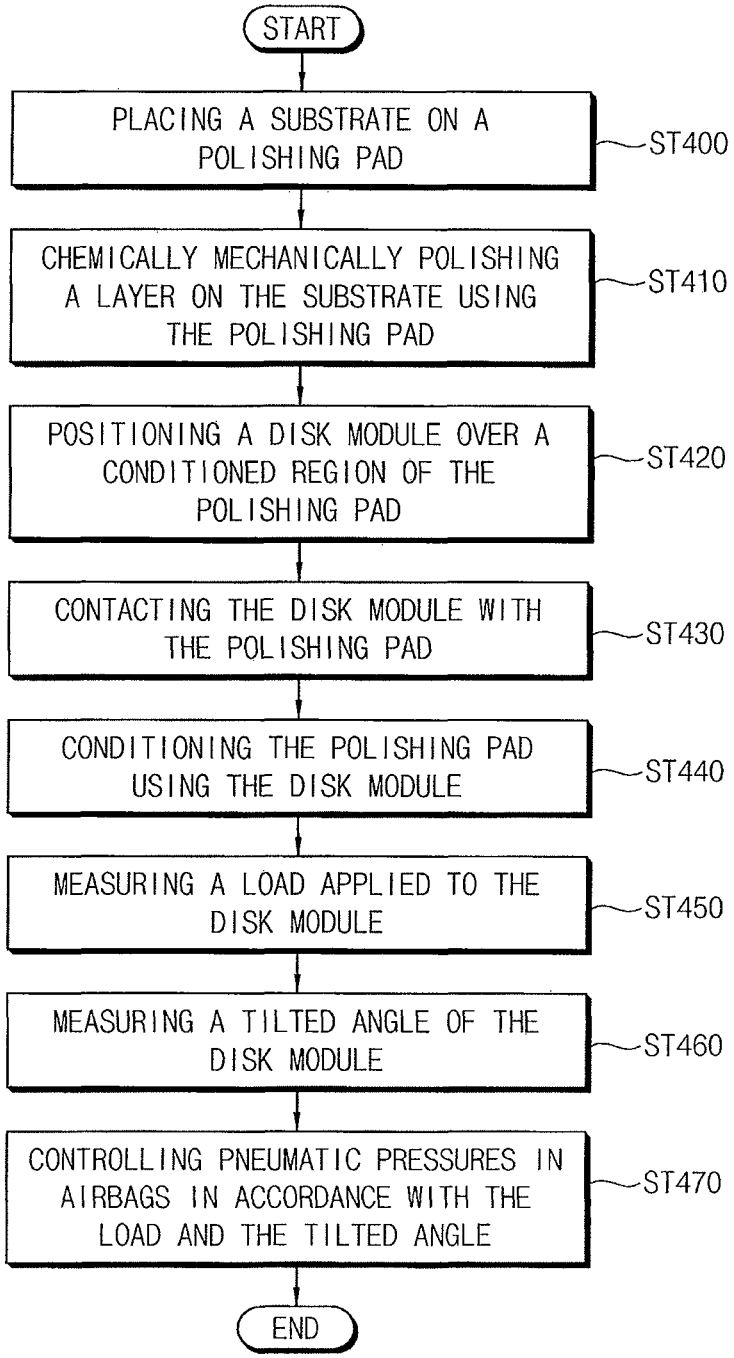
FIG. 25 illustrates a flow chart of stages in a method of manufacturing a semiconductor device using the CMP apparatus in FIG. 24.

FIG. 25 is a flow chart illustrating a method of manufacturing a semiconductor device using the CMP apparatus in FIG. 24.

Referring to FIGS. 24 and 25, the substrate having the layer may be arranged on the upper surface of the polishing pad P (ST400). The CMP mechanism 320 may chemically mechanically polish the layer using the polishing pad P with the slurry (ST410).

The arm module 110 may rotate the lifting module 120, the driving module 130, the disk module 140, the connection module 50, and the airbag module 160 to position the disk module 140 over a conditioned region of the polishing pad P (ST420).

The lifting module 120 may downwardly move the driving module 130, the disk module 140, the connection module 150, and the airbag module 160 toward the polishing pad P to contact the disk module 140 with the polishing pad P (ST430).

The driving module 130 may rotate the disk module 140 (ST440). Thus, the rotating disk module 140 may pressurize the polishing pad P to condition the polishing pad P.

The load cell 170 may measure the load applied to the disk module 140 from the lifting module 120 (ST450). The load measured by the load cell 170 may be transmitted to the controller 190.

The angle sensor module 180 may measure the tilted angle of the driving module 130 with respect to the lifting module 120 (ST460). The tilted angle of the driving module 130 measured by the angle sensor module 180, i.e., the tilted angle of the disk module 140, may be transmitted to the controller 190.

The controller 190 may control the first and second pneumatic pressures P1 and P2 supplied to the first and second airbags 161 and 163, respectively, in accordance with the loads and the tilted angle (ST470). Particularly, the controller 190 may provide the first and second airbags 161 and 163 with the different pneumatic pressures in accordance with the tilted angle of the disk module 140 measured by the angle sensor module 180 to correct the tilting of the disk module 140. Further, the conditioning force applied to the polishing pad P from the disk module 140 may correspond to a sum of the load of the lifting module 120 and the pressures in the first and second airbags 161 and 163.

Therefore, the controller 190 may selectively control the pneumatic pressures in the first and second airbags 161 and 163 to provide the disk module 140 with an optical conditioning force.

By way of summation and review, a connection module of a conditioner in a CMP mechanism may be arranged between a motor for rotating a conditioning disk and the conditioning disk. The connection module may directly receive a vertical load of the conditioner and a friction moment between the rotating conditioning disk and the connection module, so that the connection module may have weak fatigue failure. However, since only the conditioning disk may contact the inclined polishing pad, a vertical load loss of the conditioner may be generated, thereby causing the conditioner to have low conditioning capacity.

In contrast, example embodiments provide a conditioner having improved conditioning capacity. Example embodiments also provide a CMP apparatus including the above-mentioned conditioner. Example embodiments also provide a method of manufacturing a semiconductor device using the above-mentioned CMP apparatus.

That is, according to example embodiments, the connection module may connect the driving module to the lifting module to allow the tilting of the driving module with respect to the lifting module so that the connection module may have improved durability with respect to a fatigue failure caused by a friction between the polishing pad and the disk module. Further, the airbag module may include at least two airbags in the connection module so that deformations of the connection module may be buffered by the airbags. Particularly, different pressures may be applied to the airbags in accordance with slopes of the disk module so that the disk module may uniformly contact the polishing pad. As a result, the conditioner may have improved conditioning capacity. Therefore, the polishing pad conditioned by the conditioner may also have improved polishing capacity so that the CMP apparatus may have improved CMP capacity.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A conditioner of a chemical mechanical polishing (CMP) apparatus, the conditioner comprising:
- a disk to polish a polishing pad of the CMP apparatus;
- a driver to rotate the disk;
- a lifter to lift the driver;
- an arm to rotate the lifter;
- a connector to connect the driver to the lifter, the driver and the lifter being connected to vertically non-overlapping portions of the connector such that the driver is tiltable with respect to the lifter; and
- an airbag mechanism in the connector, the airbag mechanism including at least two airbags in the connector.

2. The conditioner as claimed in claim 1, wherein the connector includes a spherical bearing connecting the lifter to the driver, the lifter being tiltable relative to the driver.

3. The conditioner as claimed in claim 2, wherein the spherical bearing includes:
- an outer ring attached to the lifter; and
- an inner ring tiltably received in the outer ring, the inner ring being attached to the driver.

4. The conditioner as claimed in claim 3, wherein the connector further includes:
- a lower extension plate under a lower surface of the outer ring, the lower extension plate protruding beyond an outer circumferential surface of the outer ring; and
- an upper extension plate arranged above an upper surface of the outer ring, the upper extension plate protruding beyond the outer circumferential surface of the outer ring, the airbag mechanism being positioned outside the outer circumferential surface of the outer ring between the lower extension plate and the upper extension plate.

5. The conditioner as claimed in claim 3, wherein the connector further includes an extension plate on an upper surface of the inner ring to define a space for receiving the airbag mechanism between the outer ring and the extension plate.

6. The conditioner as claimed in claim 1, wherein the airbag mechanism includes:
- a first airbag block in the connector and having a first airbag;
- a first air line connected to the first airbag to supply a first pneumatic pressure to the first airbag;
- a second airbag block in the connector and having a second airbag;
- a second air line connected to the second airbag to supply a second pneumatic pressure to the second airbag; and
- a controller to control the first and second pneumatic pressures.

7. The conditioner as claimed in claim 6, wherein the first and second airbags include a flexible material.

8. The conditioner as claimed in claim 1, wherein the airbag mechanism includes:
- a first airbag block in the connector and having a first airbag;
- a first air line connected to the first airbag to supply a first pneumatic pressure to the first airbag;
- a second airbag block in the connector and having a second airbag;
- a second air line connected to the second airbag to supply a second pneumatic pressure to the second airbag;
- a third airbag block in the connector and having a third airbag;
- a third air line connected to the third airbag to supply a third pneumatic pressure to the third airbag;
- a fourth airbag block in the connector and having a fourth airbag;
- a fourth air line connected to the fourth airbag to supply a fourth pneumatic pressure to the fourth airbag; and
- a controller to control the first to fourth pneumatic pressures.

9. The conditioner as claimed in claim 8, wherein the first to fourth airbags include a flexible material.

10. The conditioner as claimed in claim 1, further comprising an angle sensor on the connector to measure a tilted angle of the driver.

11. The conditioner as claimed in claim 1, further comprising a load cell on the lifter to measure a load applied to the disk from the lifter.

* * * * *